US005337113A

United States Patent [19]

Kagawa et al.

[11] Patent Number: 5,337,113

[45] Date of Patent: Aug. 9, 1994

[54] PHOTOSENSITIVE MATERIAL PROCESSING APPARATUS

[75] Inventors: Yasuhiro Kagawa; Yohko Takegawa, both of Kanagawa, Japan

[73] Assignee: Fuji Photo Film Co., Ltd., Kanagawa, Japan

[21] Appl. No.: 936,530

[22] Filed: Aug. 28, 1992

[30] Foreign Application Priority Data

Aug. 30, 1991 [JP] Japan ..... 3-220448

[51] Int. Cl.[5] ..... G03D 13/00; G03D 3/02

[52] U.S. Cl. ..... 354/298; 354/324

[58] Field of Search ..... 354/324, 298, 319–323, 354/331; 134/64 P, 64 R, 122 P, 122 R

[56] References Cited

U.S. PATENT DOCUMENTS 4,182,567 1/1980 Laar et al. ..... 354/324 X
4,669,847 6/1987 Taniguchi et al. ..... 354/298
5,023,643 6/1991 Lynch et al. ..... 354/324 X
5,055,870 10/1991 Ohba et al. ..... 354/324 X

*Primary Examiner*—D. Rutledge
*Attorney, Agent, or Firm*—Sughrue, Mion, Zinn, Macpeak & Seas

[57] ABSTRACT

A photosensitive material processing apparatus which processes a photosensitive material by a processing solution stored in a processing tank, while the photosensitive material is being conveyed. The photosensitive material processing apparatus is equipped with an integration device which integrates processed amounts of the photosensitive material. By detecting a discharging of the processing solution or detecting a changing of a filter, a processed amount integrated value of the integration device is reset automatically. The processing solution and the filter can be changed at appropriate times, and the performance of the photosensitive material processing apparatus can be maintained at optimal conditions.

20 Claims, 13 Drawing Sheets

PHOTOSENSITIVE MATERIAL PROCESSING APPARATUS

BACKGROUND OF THE INVENTION

1. Field of the Invention

The present invention relates to an apparatus for processing a photosensitive material, which is equipped with an integration device which, after an exposed photosensitive material is processed, counts or integrates the amount of the processed photosensitive material or amounts of replenishing fluid, to determined the time to change a filter which filters a processing solution or the time to change the processing solution.

2. Description of the Related Art

A photosensitive material upon which images are exposed, e.g., a silver halide photographic film, is processed continuously through developing, fixing, and washing processes in a developing apparatus. In the apparatus, processing solutions stored in processing tanks, such as developer solution stored in a developing tank and fixing solution in a fixing tank, are respectively circulated through circulation paths such that the used solution may be reused. Filters, which filter the processing solutions, are provided in the circulation paths.

Components of the processing solutions are consumed in accordance with the amount of photosensitive material processed. Therefore, in order to compensate for this consumption, respective replenishing solutions are replenished to the processing solutions. In an apparatus for processing a photosensitive lithographic printing plate, for example, a PS plate or a waterless lithographic printing plate, the plate is processed through steps of developing, rinsing, squeezing, desensitizing processes and the like. In this apparatus, the plate is treated with a developer solution, rinsed with fresh developer solution or with water, squeezed and desensitized. These solutions are respectively stored in the tanks and are circulated through circulation paths. The circulation paths are provided with filters for removing solid particles which tend to particulate in the solutions.

In any of these processes, when processing is effected over a certain period of time, it has been found that the solutions become dirty, the processing performance deteriorates, and the filters become clogged. Therefore, the processing solutions in the tanks must be replaced with new solutions, and the filters must be changed after the certain period of time. Integrated or added values of the amounts of processed photosensitive material and the integrated amount of replenishing solution are used as criteria for determining the time to change the processing solutions and the time to change the filters.

However, in these processing apparatuses, when the processing solutions are replaced and the filters are changed, integration devices or the like used to integrate the amount of processed photosensitive material and the amounts of replenishing solution must be reset manually by an operator. If the operator forgets to reset the integration device, the replacing of the processing solutions and the time when the filter should be changed are inaccurate.

SUMMARY OF THE INVENTION

With the aforementioned in view, an object of the present invention is to provide an apparatus for processing photosensitive materials equipped with a processed amount integration device in which a predetermined added amount is automatically reset when a processing solution or a filter is changed thereby accurately indicating the next time for changing the processing solution or filter.

A first aspect of the present invention is an apparatus for processing a photosensitive material upon which an image is exposed, by a processing solution stored in a processing tank, while the photosensitive material is being conveyed. The photosensitive material processing apparatus includes a processed amount integration device for integrating a processed amount of the photosensitive material, notification means for notifying processed amount value has been integrated by the processed amount integration device, discharging means for draining or discharging the processing solution from the processing tank, detecting means for detecting that the processing solution has been discharged from the processing tank through the discharging means or drain, and means for resetting the processed amount integrated value when a discharge of the processing solution has been detected by the detecting means.

A second aspect of the present invention is an apparatus for processing a photosensitive material upon which an image is exposed, by a processing solution stored in a processing tank, while the photosensitive material is being conveyed. The apparatus includes a processed amount integration device for adding a processed amount of the photosensitive material, notification means for notifying that a processed amount added value has been added by the processed amount integration device, detecting means for detecting that a filter for filtering the processing solution has been changed, and resetting means for resetting the processed amount added value in the integration device when a changing of the filter has been detected by the detecting means.

A third aspect of the present invention is a photosensitive material processing apparatus for processing a photosensitive material upon which an image is exposed, by a processing solution stored in a processing tank, while the photosensitive material is being conveyed. The photosensitive material processing apparatus includes a replenishing solution amount integration device for integrating amounts of replenishing solution replenished to the processing tank, notification means for notifying that an added value of replenishing solution amounts has been added by the replenishing solution amount integration device, discharging means for discharging the processing solution from the processing tank, detecting means for detecting that the processing solution within the processing tank has been discharged by the discharging means, resetting means for resetting the integrated value of replenishing solution in the integration device when a discharge of the processing solution has been detected by the first detecting means.

A fourth aspect of the present invention is a photosensitive material processing apparatus for processing a photosensitive material upon which an image is exposed, by a processing solution stored in a processing tank, while the photosensitive material is being conveyed. The photosensitive material processing apparatus includes a replenishing solution amount adding device for adding amounts of replenishing solution replenished to the processing tank, notification means for notifying that an added value of replenishing solution amounts has been added by the replenishing solution amount adding device, detecting means for detecting that a filter for filtering the processing solution has been changed, resetting means for resetting the added value of replenishing solution amount in the integration device when a changing of the filter has been detected by the detecting means.

The photosensitive material processing apparatus of the first aspect of the present invention is equipped with the integration device for integrating amounts of photosensitive material processed by the stored processing solution. The notification device notifies when the integrated value reaches a predetermined amount thereby making it known that it is time to change the processing solution.

Further, when the detecting means detects the discharge of the processing solution from the processing tank, the integration device resets the integrated value. The notification means may display the added value at all times, or may notify that the integrated value has reached the predetermined amount by means of an alarm or the like. The notification means or the detecting means may automatically reset the integration device.

The detecting means can detect the discharging of the processing solution from variations in the liquid level of the processing solution within the processing tank by a float switch or the like. Further, the detecting means can detect the discharging of the processing solution by detecting, with a diaphragm pressure switch or the like, the pressure of the processing solution at a predetermined position (preferably a bottom portion) of the processing tank. Moreover, the discharging means may detect that a sufficient amount of time has passed for all of the processing solution to be discharged from the processing tank.

In a photosensitive material processing apparatus of the second aspect of the present invention, processed amounts of the processed photosensitive material are integrated. The integrated value of the processed amounts of the photosensitive material is used as a standard for when the filter should be changed.

In the photosensitive material processing apparatus, when the detecting means detects that the filter has been changed, the added value is reset. The detection means detects that the filter has been removed from the photosensitive material printing apparatus, and detects that the replacement filter has been installed at a predetermined position in the photosensitive material processing apparatus.

In the photosensitive material processing apparatus of the third aspect of the present invention, the processing solution is replenished in accordance with the amount of processed photosensitive material. The integration device integrates the replenished amounts of replenishing solution. This integrated value of replenishing solution amounts is used as a criterion for when to change the processing solution.

In the photosensitive material processing apparatus of the fourth aspect of the present invention, the integrated value of replenishing solution amounts is used as a criterion for when to change the filter.

The amount of processed photosensitive material can itself be used as a standard for the changing of the processing solution and the filter. However, when the processing solution is replenished in accordance with the amount of photosensitive material processed, the integrated value of replenishing solution amounts can be used as a criterion for when to change the processing solution and/or the filter.

In the photosensitive material processing apparatus relating to the present invention, the changing of the processing solution or the filter is accurately detected by the respectively corresponding detection means. The integrated value corresponding to timing for changing the processing solution or to the filter can be automatically reset. In this way, there is no need for the operator to reset the integrated value of the photosensitive material each time the processing solution or the filter is changed. The processed amounts of the photosensitive lithographic printing plates after the processing solution or the filter has been changed can be integrated accurately.

Further, the processing amount integration device may include a conventional, manual reset operation.

As described above, in the photosensitive material processing apparatus relating to the present invention, when a changing of the processing solution and/or the filter is detected by the detecting means, the corresponding integrated value is reset automatically. Therefore, the amount of photosensitive material processed by the processing solution or the filter currently being used can be accurately known.

Accordingly, excellent effects can be achieved in that the processing solution or the filter can be changed at the suitable time, the performance of the photosensitive material processing apparatus can be maintained at optimal conditions, and the finishing of the processed photosensitive material does not suffer due to deterioration in the performance of the processing solution or the like.

DESCRIPTION OF THE PREFERRED EMBODIMENTS

Figure 1:
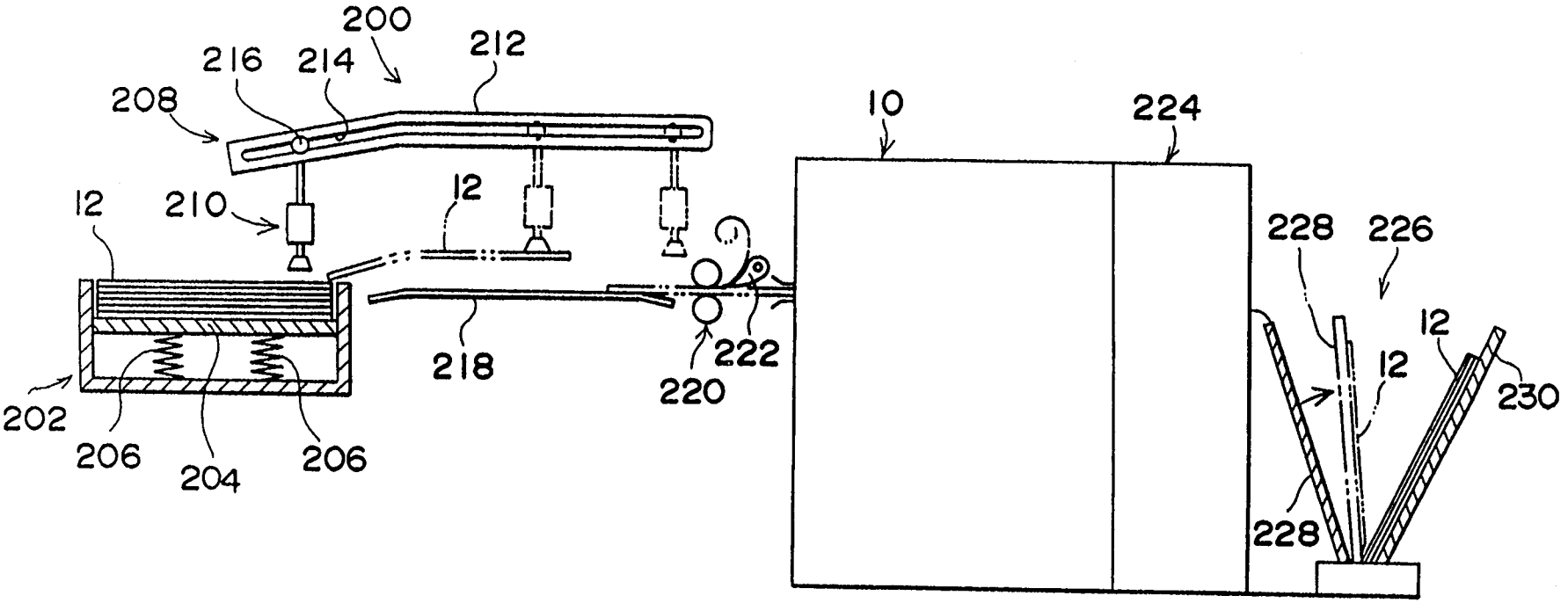
FIG. 1 is a schematic structural view of a waterless lithographic printing plate processor relating to the present embodiment.

In FIG. 1, the entire structure of a waterless lithographic printing plate processor 200 relating to the present embodiment is illustrated. Waterless lithographic printing plates 12 (hereinafter referred to as waterless PS plates), which have been exposed, are stacked in a box-shaped feeder 202. A receiving stand 204, which supports the waterless PS plates 12, is supported to the feeder 202, at a bottom portion, by compression coil springs 206. In this way, the heightwise position of the topmost waterless PS plate 12 is held virtually constant. The waterless PS plates 12 used here are formed of a primer layer, a photosensitive layer, a silicone rubber layer and a protective film being layered, in that order, upon a base of aluminum or the like.

A plate supplying mechanism 208 is disposed above the feeder 202. This mechanism 208 is formed of a suction cup portion 210, which sucks the waterless PS plates 12, and a rail portion 212, which supports the suction cup portion 210. An elongated hole 214 is formed in the rail portion 212 in the longitudinal direction thereof. A base portion of the suction cup portion 210 is movably accommodated in the elongated hole 214 via a shaft 216. As a result, the shaft 216 moves along the elongated hole 214 by the driving force of an unillustrated driving means. Accordingly, the waterless PS plate 12, which is being sucked by the suction cup portion 210, is conveyed towards a waterless PS plate processing apparatus 10.

A guide plate 218 is provided between the feeder 202 and the waterless PS plate processing apparatus 10. A pair of rollers 220 is provided at a vicinity of a front end portion of the guide plate 218 in the direction of transport. While the waterless PS plate 12, which is interposed between the rollers 220, is being conveyed further, the protective film applied to the surface is peeled off by a peeling claw 222, Thereafter, the waterless PS plate 12 reaches the waterless PS plate processing apparatus 10.

The structure of the waterless PS plate processing apparatus 10 will now be described in detail.

The waterless PS plate 12, which has been processed by the waterless PS plate processing apparatus 10, is guided through a rinsing/drying apparatus 224 to an automatic stacker 226, which is provided at a discharge port (not shown) of the rinsing/drying apparatus 224. The automatic stacker 226 is formed in a substantially V-shaped configuration by a left side wall 228 and a right side wall 230. The waterless PS plate 12, which is discharged from the discharge port of the rinsing/drying apparatus 224, is loaded onto the automatic stacker 226 so as to lean against the left side wall 228 as shown in FIG. 1. In this state, the left side wall 228 rotates with a lower end portion thereof as the center of rotation. The waterless PS plate 12 thereby leans against the right side wall 230 shown in FIG. 1 such that the waterless PS plates 12 are stacked against the right side wall 230.

Figure 2:
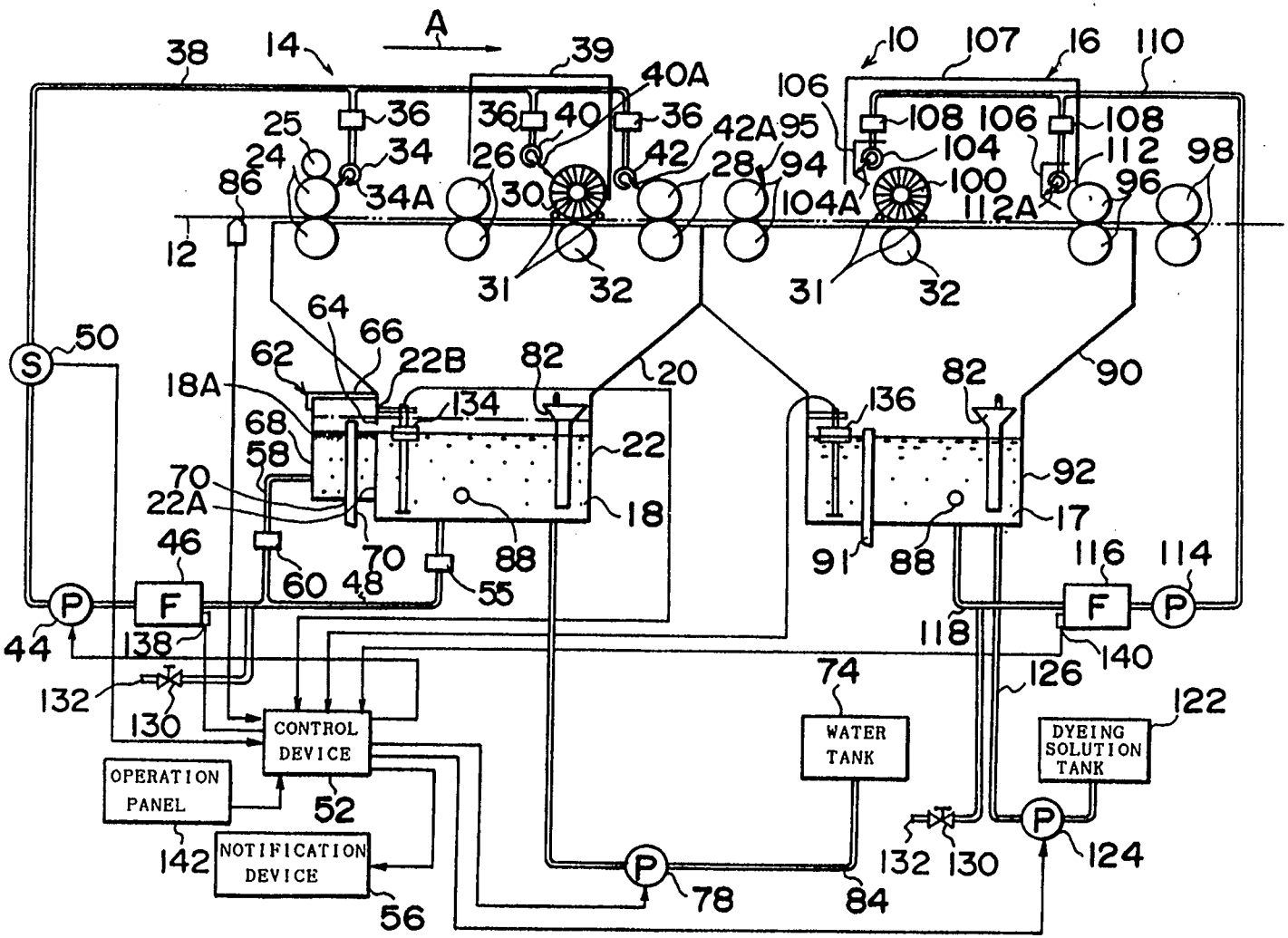
FIG. 2 is a schematic structural view of a waterless PS plate processing apparatus relating to the present embodiment.

An embodiment of the waterless PS plate processing apparatus 10, to which the present invention is applied, is illustrated in FIG. 2. The waterless PS plate processing apparatus 10 is formed of a developing section 14 and a squeezing section 16. Dyeing processing, which facilitates inspection of the plates, is effected after the waterless PS plate 12 has been developed. In the developing portion 14, the waterless PS plate can be developed by using a developing solution which contains no organic matter (hereinafter referred to as "developing water").

A squeezing solution 17 containing crystal violet, astrazone red and the like is used in the squeezing section 16.

A top portion of a developing tank main body 20 of the developing section 14 is open. A bottom portion of the developing tank main body 20 is formed like an upside-down mountain. A developing water recovery tank 22 is formed at a central portion of the bottom portion. Developing water 18 is stored within the developing water recovery tank 22.

As described above, the developing water 18 contains no organic matter. Water, such as tap water or the like, can be used. A antifoaming agent may be mixed in the water so as to prevent foam from developing during circulation of the water. Water hardness may be adjusted by adding a chelating agent. Further, the number of times the water is circulated may be increased by adding a preservative. An ozone generating apparatus may be installed to obtain the same results as a preservative.

Pairs of conveying rollers 24, 26, 28 are respectively disposed at a top portion of the developing tank main body 20 from the entering side of the waterless PS plate 12. The pairs of conveying rollers 24, 26, 28 are supported by an unillustrated rack side plate, and are rotated by a driving force of an unillustrated driving means. Accordingly, the waterless PS plates 12 are interposed between the pairs of conveying rollers 24, 26, 28, and are conveyed in the direction of arrow A shown in FIG. 2.

A squeeze bar 95 contacts the upper roller of a pair of conveying rollers 94. The squeeze bar 95 prevents the developing water adhering to the outer peripheral surface of the upper roller from spreading onto the surface of the waterless PS plate 12 and from flowing to the side at which the PS plate 12 is conveyed between the pair of conveying rollers 94. The squeeze bar 95 may also be provided at the other pairs of conveying rollers 26, 28.

The pair of conveying rollers 28 is disposed at the final portion of the conveying path of the waterless PS plate 12 inside the developing section 14. These conveying rollers 28 function as squeeze rollers which squeeze out developing water 18, which adheres to the surface of the waterless PS plate 12 in the developing portion 14, from the waterless PS plate 12.

A brush roller 30 is disposed between the pair of conveying rollers 26 and the pair of conveying rollers 28. By brushing the plate surface of the waterless PS plate 12 being conveyed, the brush roller 30 scrapes off the silicone layer of the unexposed portions on the plate surface. In the same way as the pairs of conveying rollers 24, 26, 28, the brush roller 30 is supported by an unillustrated side plate, and is rotated by a driving force of an unillustrated driving means.

The brush roller 30 is formed by fixing bristles to a roll made of plastic or metal. The surface of the waterless PS plate 12 is brushed by the brush roller 30 being rotated (correct rotation) in a direction which corresponds to the direction in which the waterless PS plate 12 is conveyed (counterclockwise rotation in FIG. 2). The number of revolutions of the brush roller 30 is set from 100 to 800 rpm (preferably 200 to 600 rpm). Further, the scraping off of the silicone layer on the plate surface of the waterless PS plate 12 can be further improved by the brush roller 30 moving reciprocally in axial directions as well as rotating.

Further, the combination of the direction of rotation of the brush roller 30 and the direction of rotation of a brush roller 100, which will be described later, in the squeezing section 16, can be selected from among the following.

| (developing section 14) | (squeezing section 16) |
|---|---|
| correct rotation/swinging | reverse rotation/swinging |
| (the combination utilized in the present embodiment) | |
| correct rotation/swinging | correct rotation/swinging |
| correct rotation/swinging | correct rotation |
| correct rotation/swinging | reverse rotation |

A rotating roller 32 is disposed at a bottom portion of the brush roller 30. While the waterless PS plate 12 passes between the rotating roller 32 and the brush roller 30, the surface of the waterless PS plate 12 is brushed by the brush roller 30. The silicone layer of the unexposed portions is thereby reliably scraped off. Moreover, eclipse preventing bars 31 are provided at vicinities where the brush roller 30 contacts the waterless PS plate 12. When end portions of the waterless PS plate 12 contact the bristles of the brush roller 30, the eclipse preventing bars 31 prevent the end portions of the waterless PS plate 12 from being rolled upward by the rotating force of the brush roller 30.

A spray pipe 34 is disposed above the pair of conveying rollers 24. The spray pipe 34 opposes the upper roller of the pair of conveying rollers 24. Discharge openings 34A are formed in the spray pipe 34 so as to be spaced apart at appropriate distances along the axial direction. The spray pipe 34 communicates with a developing water circulating apparatus, which will be described later, by a conduit 38 via a valve 36. Accordingly, developing water 18, which is sent to the spray pipe 34, is discharged onto the upper roller of the pair of conveying rollers 24, which in turn apply the developing water 18 onto the waterless PS plate 12.

Further, spray pipes 40, 42 are disposed between the pair of conveying rollers 26 and the pair of conveying rollers 28. The spray pipe 40 is disposed between the brush roller 30 and the pair of conveying rollers 26. Discharge openings 40A are formed in the spray pipe 40 in the same way as in the aforementioned spray pipe 34. The discharge openings 40A of the Spray pipe 40 are provided so as to oppose the brush roller 30. In the same way as the spray pipe 34, the spray pipe 40 communicates with the developing water circulating apparatus, which will be described later, via a valve 36 through a conduit which diverges from the conduit 38. In this way, developing water which is sent to the spray pipe 40 is discharged onto the brush roller 30, and is supplied to the waterless PS plate 12.

The spray pipe 42 opposes the upper roller of the pair of conveying rollers 28. Discharge openings 42A are formed in the spray pipe 42. The spray pipe 42 communicates with the developing water circulating apparatus, which will be described later, via a valve 36 through a conduit which diverges from the conduit 38. Accordingly, developing water is sent to the spray pipe 42 and is discharged to the upper roller of the pair Of conveying rollers 28.

A cover 39 having a substantially U-shaped cross section is disposed so as to cover an area from the conveying rollers 26 to an upper portion of the brush roller 30. The cover 39 prevents the developing water 18 from being scattered by the brush roller 30.

The developing water circulating apparatus is formed of a circulating pump 44, a filter 46, and a conduit 48 by which the circulating pump 44 and the developing water recovery tank 22 communicate.

The circulating pump 44 is a variable flow rate pump. The circulating pump 44 is connected to a control device 52 by which the discharge flow rate of the circulating pump 44 is controlled. The conduit 38 communicates with the discharge opening side of the circulating pump 44. One end of the conduit 48 communicates with the suction opening side of the circulating pump 44. Another end of the conduit 48 communicates with the bottom portion of the developing water recovery tank 22 via a valve 55 disposed midway along the conduit 48. By operating the circulating pump 44, the developing water inside of the developing water recovery tank 22 passes through the conduit 48, is sucked by the circulating pump 44, and is sent through the conduit 38 to the spray pipes 34, 40, 42.

A variable flow rate sensor 50, in which wire is connected to a control device 52, is disposed at an intermediate portion of the conduit 38. The variable flow rate sensor 50 detects the flow rate of the developing water passing through the conduit 38.

The filter 46 is disposed at an intermediate portion of the conduit 48. The filter 46 filters the developing water passing through the conduit 48 so as to remove scrapings therefrom. These scrapings 18A are mainly those from the silicone layer which are scraped off of the surface of the waterless PS plate 12.

A notification device 56 is connected to the control device 52 and announces that it is time to change the filter 46 when the flow rate of the developing water 18 flowing within the conduit 38 is less than or equal to a predetermined flow rate. In this way, the filter 46 can be changed. A filter whose meshes are 10μ to 500μ (preferably 50μ to 300μ ) is used.

An offshoot conduit 58 diverges from an intermediate portion of the conduit 48. The offshoot conduit 58 communicates, via a valve 60, with an overflow tank 62, which is a collection tank. The overflow tank 62 is disposed at a side portion of the developing water recovery tank 22, and is separated therefrom by a separating wall. The overflow tank 62 communicates with the developing water recovery tank 22 by an elongated hole 64, which is formed along the liquid surface of the developing water. The surface layer portion of the developing water 18 within the developing water recovery tank 22 crosses over a top end portion of a lower portion separating wall 22A of the developing water recovery tank 22, and flows into the overflow tank 62. The amount of overflow of the developing water 18 into the overflow tank 62 is 1/10 to $\frac{2}{3}$ (preferably $\frac{1}{3}$ to $\frac{1}{2}$) of the entire amount of developing water being circulated.

An upper portion separating wall 22B is provided to prevent the scrapings 18A, which are temporarily collected within the overflow tank 62, from spreading into the developing water recovery tank 22 when the developing water 18 is replenished by a developing water replenishing apparatus, to be described later, and the liquid level of the developing water 18 rises.

The overflow tank 62 can be opened or closed by a lid 66 provided above the overflow tank 62. The lid 66 can be removed during maintenance of the interior of the overflow tank 62. Further, the developing water within the overflow tank 62 is sucked by the offshoot conduit 58, which penetrates the bottom portion of a side wall 68 of the overflow tank 62, when the circulating pump 44 is operated. The surface layer portion of the developing water inside the developing water recovery tank 22 flows into the overflow tank 62 due to the suction of the circulating pump 44. The scrapings 18A, which are floating in the developing water inside the developing water recovery tank 22, flow into the overflow tank 62 so as to collect the scrapings 18A therein. In this case, a silicone rubber layer, which is used as an ink-resisting layer, is layered on the surface of the waterless PS plate 12. When the silicone rubber layer of the unexposed portions is scraped off by the brush roller 30, it becomes scrapings 18A which are recovered inside the developing water recovery tank 22 along with the excess developing water. Because, in the developing water 18 within the developing water recovery tank 22, the specific gravity of the scrapings 18A is lower than that of the developing water, the scrapings 18A float to the surface layer portion of the developing water. Further, the lower portion separating wall 22A serves as a dam as the scrapings 18A of the surface layer inside the developing water recovery tank 22 flow into and collect in the overflow tank 62. When the liquid level of the developing water 18 within the overflow tank 62 rises due to replenishment of the developing water 18 (to be described later), the upper portion separating wall 22B serves as a dam as it prevents the temporarily collected scrapings 18A from spreading into the developing water recovery tank 22.

An overflow pipe 70 is disposed within the overflow tank 62. The overflow pipe 70 penetrates through the bottom portion of the overflow tank 62. An upper end portion of the overflow pipe 70 is set higher than an upper end of the elongated hole 64. In this way, when the developing water 18 is replenished by the developing water replenishing apparatus, which will be described later, and the liquid level of the developing water 18 within the developing water recovery tank 22 rises (to the position shown by the two-dot chain line in FIG. 2), the overflow pipe 70 submerges. Along with the scrapings 18A, the surface layer portion of the developing water 18 within the overflow tank 62 flows through the overflow pipe 70 to the exterior.

The developing water replenishing apparatus is formed by a water tank 74, in which water is accommodated, and a water replenishing pump 78, which is used to supply water to the interior of the developing water recovery tank 22. The water sent to the developing water recovery tank 22 by the water replenishing pump 78 is sent into a cylindrical replenishing cylinder 82. Water supplied thereto is replenished to a vicinity of a bottom portion of the developing water recovery tank 22 from an opening at a lower end portion of the replenishing cylinder 82.

The control device 52 is disposed at the entry side of the developing section 14. A plate detector 86, which detects the amount of waterless PS plate 12 passing through, i.e., the amount to be processed (for example, the surface area of the waterless PS plate 12 to be processed), is connected to the control device 52. The control device 52 thereby detects the processed amount. A plurality of photoelectric tubes are disposed in the plate detector 86 along the transverse direction of the waterless PS plate 12 so as to measure the time in which the waterless PS plate 12 passes by an upper portion of the plate detector 86. Accordingly, the area of the surface of the plate may be detected. It also suffices to input, by a device in advance, the length of the transverse direction of the waterless PS plate 12, and detect the surface area by detecting the length with a single photoelectric tube.

A heater 88 is disposed at the bottom portion of the developing water recovery tank 22. The heater 88 is connected to an unillustrated power source and heats the developing water 18. The temperature of the developing water 18 is set at 15° C. to 60° C. (preferably 25° C. to 50° C.) by the heater 88.

The developing time in the waterless PS plate processing apparatus 10 is set at 10 seconds to 3 minutes (preferably 30 seconds to 2 minutes). The squeezing time is set at 5 seconds to 1 minute (preferably 10 seconds to 30 seconds). A developing tank may be added as occasion demands.

Next, the squeezing section 16 will be described.

The top portion of a squeezing tank main body 90 of the squeezing section 16 is open in the same way as in the developing tank main body 20. The bottom portion of the squeezing tank main body 90 is formed as an upside-down mountain. A squeezing solution recovery tank 92 is formed in a central portion of the bottom portion of the squeezing tank main body 90. Dyeing solution 17 is stored within the squeezing solution recovery tank 92. An overflow pipe 91 is disposed within the squeezing solution recovery tank 92. An upper end of the overflow pipe 91 is positioned in an upper portion of the squeezing solution recovery tank 92. A lower end of the overflow pipe 91 penetrates through the bottom of the squeezing solution recovery tank 92 and projects toward the exterior. When the squeezing solution is replenished by a squeezing solution replenishing apparatus, which will be described later, and the liquid level within the developing solution recovery tank 92 rises above the upper end of the overflow pipe 91, the surface layer portion of the squeezing solution 17 is discharged from the overflow pipe 91 to the exterior. In this way, the liquid level of the squeezing solution 17 within the squeezing solution recovery tank 92 is maintained substantially constant.

Pairs of conveying rollers 94, 96 are disposed in the top portion of the squeezing tank main body 90 along the conveying direction of the waterless PS plate 12 in that order from the entry side of the squeezing tank main body 90. The conveying rollers 94, 96 are supported by an unillustrated rack side plate and are rotated by a driving force from an unillustrated driving means. The waterless PS plate 12 is interposed between and conveyed by the respective pairs of conveying rollers 94, 96. The pairs of conveying rollers 94, 96 are made of ordinary rubber so that the surface of the waterless PS plate 12 being conveyed is not damaged.

A top end portion of a blade 95 contacts the upper roller of the pair of conveying rollers 94. Accordingly, the scrapings which adhere to the pair of conveying rollers 94 are scraped off by the blade 95 so that the smoothness of the surfaces of the pair of conveying rollers 94 is maintained. Further, a blade may be provided at the pair of conveying rollers 96.

A pair of conveying rollers 98 is disposed at the side of the squeezing tank main body 90 which is downstream in the conveying direction of the waterless PS plate 12. The waterless PS plate 12 is interposed between and conveyed by the pair of conveying rollers 98. The pair of conveying rollers 98 also serves to wipe the squeezing solution 17 off of the surface of the waterless PS plate 12. The pair of conveying rollers 98 is formed of NBR (nitrile butadiene rubber) or molten rollers or the like so that the wiping off of the squeezing solution 17 is improved.

A brush roller 100 is disposed between the pairs of conveying rollers 94 and 96. In the same way as the pairs of conveying rollers 94, 96, the brush roller 100 is supported by an unillustrated rack side plate, and is rotated in the direction opposite to the direction of rotation of the pairs of conveying rollers 94, 96 (the brush roller 100 rotates in the clockwise direction in FIG. 2) by a driving force of an unillustrated driving means. The brush roller 100 is formed by fixing bristles to a roll made of plastic or metal. The surface of the waterless PS plate 12 is brushed by the brush roller 100 being rotated in the direction (clockwise direction in FIG. 2) opposite to the conveying direction of the waterless PS plate 12. The previously described combinations of the direction of rotation of the brush roller 100 and the direction of rotation of the brush roller 30 can be used. The number of revolutions of the brush roller 100 is set at 100 to 800 rpm (preferably 200 to 600 rpm).

A rotating roller 32 is provided beneath the brush roller 100. As a result, when the waterless PS plate 12 passes by, it is conveyed between the brush roller 100 and the rotating roller 32. The squeezing solution 17 is applied to the surface of the waterless PS plate 12 by the brush roller 100. Further, eclipse preventing bars 31 are disposed at vicinities where the brush roller 100 contacts the waterless PS plate 12. When end portions of the waterless PS plate 12, which is being conveyed, contact the bristles of the brush roller 100, the eclipse preventing bars 31 prevent the end portions of the waterless PS plate 12 from being rolled upward by the rotating force of the brushes.

A spray pipe 104 is disposed above the brush roller 100. The spray pipe 104 is enclosed by a substantially U-shaped flow-adjusting plate 106. An appropriate number of discharge openings 104A, which oppose a concave portion of the flow-adjusting plate 106, are provided in the spray pipe 104 along the axial direction thereof.

The spray pipe 104 communicates with the squeezing solution circulating apparatus, which will be described later, by a conduit 110 via a valve 108. In this way, the squeezing solution 17 is sent to the spray pipe 104, discharged toward the flow-adjusting plate 106, guided by the flow-adjusting plate 106, and supplied to the brush roller 100. At this time, the squeezing solution 17 flows down from the top of the flow-adjusting plate 106 and spreads so as to be supplied evenly onto the brush roller 100 along the axial direction thereof.

A spray pipe 112 is disposed between the brush roller 100 and the pair of conveying rollers 96 at the side of the pair of conveying rollers 96. In the same way as the spray pipe 104, the spray pipe 112 is enclosed by a substantially U-shaped flow-adjusting plate 106. An appropriate number of discharge openings 112A, which oppose the flow-adjusting plate 106, are provided in the spray pipe 112 along the axial direction thereof. In the same way as the spray pipe 104, the spray pipe 112 communicates with the squeezing solution circulating apparatus, which will be described later, by a conduit 110 via a valve 108. In this way, the squeezing solution 17 is sent to the spray pipe 112, is discharged toward and guided by the flow-adjusting plate 106 so as to be supplied to the upper roller of the pair of conveying rollers 96. At this time, the squeezing solution 17 flows down from the top of the flow-adjusting plate 106 and spreads so as to be supplied evenly onto the pair of conveying rollers 96 along the axial direction thereof.

A cover 107 having a substantially U-shaped cross section is disposed above the brush roller 100 and the pair of conveying rollers 96. The cover 107 prevents the squeezing solution 17 from being scattered by the brush roller 100.

The squeezing solution circulating apparatus is formed by a circulating pump 114, a filter 116, and a conduit 118, which communicates the circulating pump 114 and the squeezing solution recovery tank 92. The conduit 110 communicates with the discharge opening side of the circulating pump 114. One end of the conduit 118 communicates with the suction opening side of the circulating pump 114. Another end of the conduit 118 communicates with the bottom portion of the squeezing solution recovery tank 92. By operation of the circulating pump 114, the squeezing solution 17 within the squeezing solution recovery tank 92 flows through the conduit 118, is sucked by the circulating pump 114, and flows through the conduit 110 to be sent to the spray pipes 104, 112.

The filter 116 is disposed at an intermediate portion of the conduit 118 and removes scrapings from the squeezing solution 17 flowing within the conduit 118. These scrapings are mainly scrapings from the silicone layer which are scraped off of the surface of the waterless PS plate 12 which is brought from the developing section 14.

The squeezing solution replenishing apparatus is formed by a squeezing solution tank 122, in which the squeezing solution 17 is accommodated, and a squeezing solution replenishing pump 124, which is used to supply the squeezing solution 17 to the interior of the squeezing solution recovery tank 92.

One end of a conduit 126 communicates with the squeezing solution tank 122. Another end of the conduit 126 opens at the replenishing cylinder 82, which is disposed within the squeezing solution recovery tank 92. The squeezing solution replenishing pump 124 is disposed midway along the conduit 126. The squeezing solution replenishing pump 124 is connected to the control device 52 such that the operational timing, i.e., the operation during replenishment of the squeezing solution 17, is controlled by the control device 52. The replenishing amount of the squeezing solution 17 is set to be 5 to 100 cc/m$^2$ (preferably 10 to 60 cc/m$^2$).

A heater 88 is disposed within the squeezing solution recovery tank 92 at a bottom portion thereof. The heater 88 is connected to an unillustrated power source so as to heat the squeezing solution 17. The temperature of the squeezing solution 17 is set to 15° C. to 45° C. (preferably 20° C. to 40° C.). Dyeing tanks may be added as occasion demands.

A drain 132, which is open and shut by a valve 130, diverges from an intermediate portion of the conduit 48. The developing water 18 stored in the developing water recovery tank 22 and the overflow tank 62 are discharged from the drain 132 by operation of the valve 130. Further, a float switch 134, which is connected to the control device 52, is disposed within the developing water recovery tank 22. The control device 52 detects a drop in the liquid level of the developing water 18 within the developing water recovery tank 22 by the flow switch 134, so as to detect that the developing water 18 has been discharged from the developing water recovery tank 22. It is not essential that the float switch 134 be provided within the developing water recovery tank 22. It suffices that the float switch 134 detects the liquid level of the developing water 18 and detects whether or not the developing water 18 has been discharged from the developing water recovery tank 22.

The drain 132, which can discharge the squeezing solution 17 within the squeezing solution recovery tank 92 by operation of the valve 130, diverges from the conduit 118 of the squeezing solution circulating apparatus. A float switch 136, which is connected to the control device 52, is disposed within the squeezing solution recovery tank 92. The control device 52 detects a drop in the liquid level of the squeezing solution 17 within the squeezing solution recovery tank 92 by the float switch 136, so as to detect that the squeezing solution 17 has been discharged from the squeezing solution recovery tank 92.

Filter switches 138, 140, in which contacting points are switched in accordance with installation and removal of the filters 46, 116, are provided on the filters 46, 116. The filter switches 138, 140 are connected to the control device 52. The contacting points are switched by, for example, a microswitch or the like which has been waterproofed, detecting the existence of the installation of the filters 46, 116. This data is output to the control device 52. Accordingly, the control device 52 detects that the filters 46, 116 have been changed.

The counting device of the waterless PS plate processing apparatus 10 is formed by the plate detector 86, the float switches 134, 136, the filter switches 138, 140, and the control device 52.

The control device 52 measures the length and width of the inserted waterless PS plate 12 by the plate detector 86, and calculates the processed surface area of the waterless PS plate 12. These calculated results are successively integrated by an unillustrated counter within the control device 52.

A developing water counter, a squeezing solution counter, a developing water filter counter, and a squeezing solution filter counter are provided within the control device 52. The data of each counter can be individually reset by a key operation from an operation panel 142 or the like.

Next, the operation of the present embodiment will be described.

At the waterless PS plate 12, on which images have been printed by an unillustrated image printing apparatus, portions of the photosensitive layer on which light has been irradiated, i.e., the exposed portions, harden and adhere to the silicone rubber layer. When the developing water 18 is applied, the unexposed portions of the photosensitive layer can swell or be eluted.

As seen in FIG. 1, the protective film, which has been laminated onto the surface of the waterless PS plate 12 in order to protect it, is peeled off by the peeling claw 222. Thereafter, the waterless PS plate 12 is fed into the waterless PS plate processing apparatus 10. The waterless PS plate 12 is conveyed to the developing portion 14 while being detected by the plate detector 86. In the developing section 14, the developing water 18 is applied to the surface of the waterless PS plate 12 as the waterless PS plate 12 is interposed between and conveyed by the pair of conveying rollers 24 (FIG. 2). Accordingly, the photosensitive layer of the unexposed portions of the waterless PS plate 12 swell, and the silicone rubber layer is easily peeled off.

The waterless PS plate 12 is interposed between and conveyed by the pair of conveying rollers 26, and is inserted between the brush roller 30 and the rotating roller 32. The brush roller 30 rotates in a direction corresponding to the conveying direction of the waterless PS plate 12 (the brush roller 30 rotates counterclockwise in FIG. 2). The top surface of the waterless PS plate 12, which is being conveyed on top of the rotating roller 32, is brushed. The developing water 18 is also being supplied to the brush roller 30. As the developing water 18 is being applied to the waterless PS plate 12, the surface is brushed by the brush roller 30. The silicone rubber layer is scraped off by the developing water 18. In this way, the portions of the photosensitive layer and the silicone rubber layer which correspond to the exposed portions remain on the waterless PS plate 12, and positive images are thereby formed.

The developing water 18 which is left over, after developing, from the developing water 18 applied to the surface of the waterless PS plate 12 falls down into the developing water recovery tank 22 and is recovered.

As the waterless PS plate 12, from which the silicone rubber layer of the unexposed portions has been scraped off by the brush roller 30, is interposed between and conveyed by the pair of conveying rollers 28, the developing water 18 applied again to the surface of the waterless PS plate 12 is squeezed out. In this state, the waterless PS plate 12 is inserted between the pair of conveying rollers 94 of the squeezing section 16. The waterless PS plate 12 is interposed between and conveyed by the pair of conveying rollers 94, and is thereby inserted between the brush roller 100 and the rotating roller 32. The brush roller 100 rotates in the direction opposite to the conveying direction of the waterless PS plate 12 (the brush roller 100 rotates clockwise in FIG. 2). The squeezing solution 17, which is guided and supplied by the flow-adjusting plate 106, is applied to the top surface of the waterless PS plate 12. In this way, the squeezing solution 17 bonds to the photosensitive layer of the unexposed portions so that the unexposed portions are squeezed.

The waterless PS plate 12 is inserted between the pair of conveying rollers 96. The squeezing solution 17, which has been guided and supplied by the flow-adjusting plate 106 to the upper roller of the pair of conveying rollers 96, is applied to the surface of the waterless PS plate 12, and is squeezed out. The squeezing process of the waterless PS plate 12 is a process which allows the image portions and the non-image portions of the developed waterless PS plate 12 to be more easily distinguished, and is a process which is effected for the inspection operation.

The waterless PS plate 12, whose image portions have been squeezed, is delivered out from the squeezing section 16. Thereafter, the waterless PS plate 12 is inserted between the pair of conveying rollers 98 so that the squeezing solution 17 remaining on the surface thereof is wiped off. If the squeezing solution 17 remains on the non-image portions in particular, the ink resistance of the silicone rubber layer deteriorates. Therefore, a high-quality print cannot be obtained during printing. However, because the squeezing solution 17 is reliably squeezed off of the surfaces by the pair of conveying rollers 98, a high-quality print can be obtained. Further, rinsing and drying processes may be provided after the aforementioned processes.

Next, the circulation of the developing water 18 in the developing section 14, the removal of scrapings, and the replenishment of the developing water 18 will be described.

Circulation

As shown in Fig. 2, the developing water 18 within the developing water recovery tank 22 is sent to the spray pipes 34, 40, 42 by the operation of the circulating pump 44. The developing water 18 is applied to the waterless PS plate 12 which is being conveyed through the developing section 14. The excess developing water 18, after application of the developing water 18 to the waterless PS plate 12, falls down and is recovered within the developing water recovery tank 22. The scrapings 18A, such as the silicone rubber layer and the like which have been peeled from the surface of the waterless PS plate 12, are included in the developing water 18 which is recovered within the developing water recovery tank 22. Because the specific gravity of the scrapings 18A is less than that of the developing water 18, the scrapings 18A float on the surface of the developing water 18 within the developing water recovery tank 22.

Removal of Scrapings

The developing water 18 within the developing water recovery tank 22 flows over the lower portion separating wall 22A and into the overflow tank 62. Accordingly, the scrapings 18A, which float on the surface of the developing water 18, flow into the overflow tank 62 and are collected therein.

When the developing water recovery tank 22 is replenished with developing water, the liquid level of the developing water within the developing water recovery tank 22 rises. When the developing water rises above the elongated hole 64, the liquid level of the developing water 18 (on whose surface the scrapings 18A collect) within the overflow tank 62 also rises. The top end portion of the overflow pipe 70 is submerged (the state illustrated by the dot-chain line in FIG. 2).

Accordingly, beginning with the surface (on which the scrapings 18A are floating), the developing water 18 within the developing water recovery tank 22 passes into the overflow pipe 70 and is discharged to the exterior.

At this time, the upper portion separating wall 22B, in which the elongated hole 64 is formed, of the developing water recovery tank 22 functions as a dam. The scrapings, which are temporarily collected within the overflow tank 62, thereby do not spread into the developing water recovery tank 22 when the liquid level of the developing water 18 rises due to the replenishment of the developing water 18.

In this way, in the present embodiment, the scrapings 18A are discharged to the exterior by the overflow pipe 70 when the water is replenished. Therefore, there is less clogging of the filter, and stable developing can be effected for a long period of time. Further, the circulation route of the developing water 18 is formed into two routes by the offshoot conduit 58 and the conduit 48 such that the scrapings 18A can be removed from the developing water 18. Therefore, the scrapings 18A do not collect in the developing water recovery tank 22 and the circulating pump 44, and maintenance thereof is facilitated.

Replenishment of Developing Water

The waterless PS plate 12 inserted into the developing section 14 and the amount to be processed are detected by the plate detector 86.

The control device 52 operates the water supplying pump 78, based on the results of the above-mentioned detection, so that the developing water 18 is supplied from the water tank 74 to the developing water recovery tank 22. This replenishing is effected in accordance with the processed amount, i.e., the processed surface area, of the waterless PS plate 12.

The replenishing amount of the water is set to be 250 to 2000 cc for each time the developing water is replenished. Methods of supplying the developing water 18 include a method in which the developing water 18 is supplied regularly in a range of 0.1 liters/portion to 10 liters/portion while the waterless PS plate processing apparatus 10 is being operated, and the developing water 18 is discharged from the overflow tank.

Next, the replenishing of the squeezing solution 17 of the squeezing section 16 will be explained.

The developing water 18 remains on the surface of the waterless PS plate 12 inserted into the squeezing section 16. In this state, the squeezing solution 17 is applied. As a result, the squeezing solution 17 recovered in the squeezing solution recovery tank 92 after squeezing contains the developing water 18. The quality of the squeezing solution 17 thereby deteriorates. The quality of the squeezing solution 17 also deteriorates due to the amount of the waterless PS plate 12 squeezed. As a result, the control device 52 operates the squeezing solution supplying pump 124 based on the results of the detection of the surface area of the waterless PS plate 12 by the plate detector 86. The squeezing solution 17 is thereby supplied to the squeezing solution recovery tank 92. Accordingly, stable squeezing can be effected for a long period of time without the squeezing capability of the squeezing solution 17 deteriorating.

Next, the addition of the amounts of the waterless PS plate 12 processed, which is used as a standard for the changing of the developing water 18, the squeezing solution 17, the developing water filter 46, and the squeezing solution filter 116, will be explained. In the waterless PS plate processing apparatus 10, the developing water and the squeezing solution are successively replenished along with the processing of the waterless PS plate 12. Further, after a predetermined amount of the waterless PS plate 12 has been processed, the developing water and the squeezing solution are discharged, and are replaced with new solutions. Regardless of whether the developing water filter 46 and the squeezing solution filter 116 are blocked, the developing water filter 46 and the squeezing solution filter 116 are changed when the amount of the waterless PS plate 12 processed reaches a predetermined value.

Each counter of the waterless PS plate processing apparatus 10 is reset when the waterless PS plate processing apparatus 10 is transported and installed. The counters integrate the amount processed in accordance with the processing of the waterless PS plate 12.

Figure 4A:
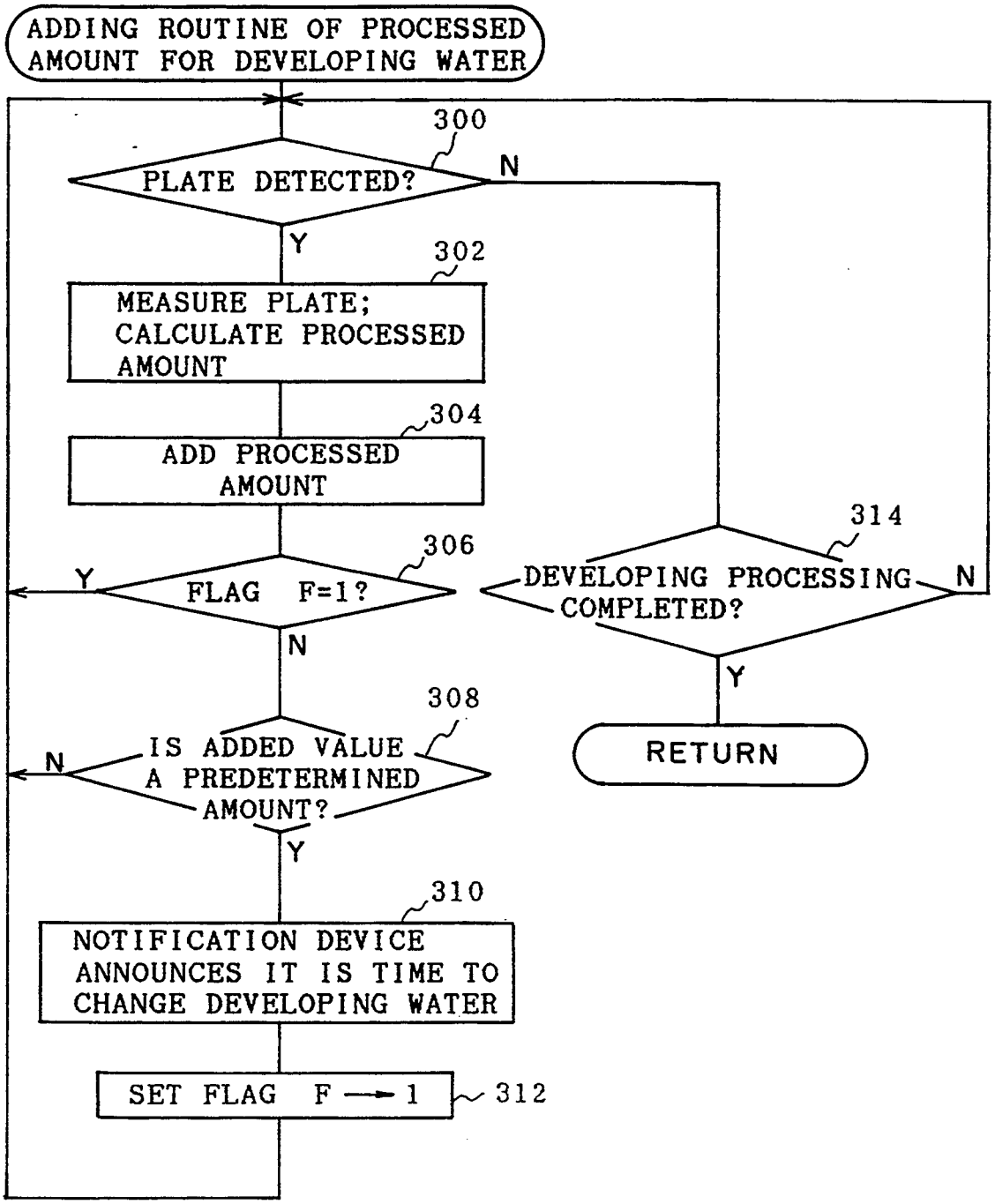
FIG. 4A is a flowchart illustrating an integration of an amount processed with respect to developing water.

First, the operation of the counter for developing water, which adds the amount of the waterless PS plate 12 processed at the waterless PS plate processing apparatus 10, will be described in accordance with the flowcharts shown in FIGS. 4A and 4B.

When a power switch is turned on, operation of the waterless PS plate processing apparatus 10 begins. In this state, the integrated value at the time of completion of the last operation is stored in the counter for developing water.

In step 300, when the plate detector 86 detects insertion of the waterless PS plate 12 into the waterless PS plate processing apparatus 10, the process moves to step 302 where the plate detector 86 detects the front end and the rear end of the inserted waterless PS plate 12. The length of the waterless PS plate 12 is measured, and the surface area to be processed is calculated, from the length, as the processed amount. Next, in step 304, this processed amount is added to the counter. In step 306, the value of a flag F is observed. The flag F is normally "0", but it is set to "1" when the amount processed by the developing water 18 reaches a predetermined amount.

Further, in step 308, a determination is made as to whether or not the integrated value has reached the predetermined amount. If the integrated value has not yet reached the predetermined amount, steps 300 through 306 are repeated as the waterless PS plates 12 are processed. The integrated value is determined in step 308.

When the amount of waterless PS plates 12 processed by the developing water 18, which is currently being used, reaches the predetermined amount, in step 310 the notification device 56 announces that it is time to change the developing water 18. The notification device 56 may show the processed amount on a display, or may inform the operator by an alarm or the like along with this display. Further, it suffices to use only an alarm.

In step 312, the flag is set to "1", and the time when the developing water 18 was changed is stored. By turning the power switch of the waterless PS plate processing apparatus 10 off without detecting the insertion of the waterless PS plate 12, it is determined that the operation has been completed (step 314). The integrated value of the counter and the state of the flag F are stored, and addition is completed.

Figure 4B:
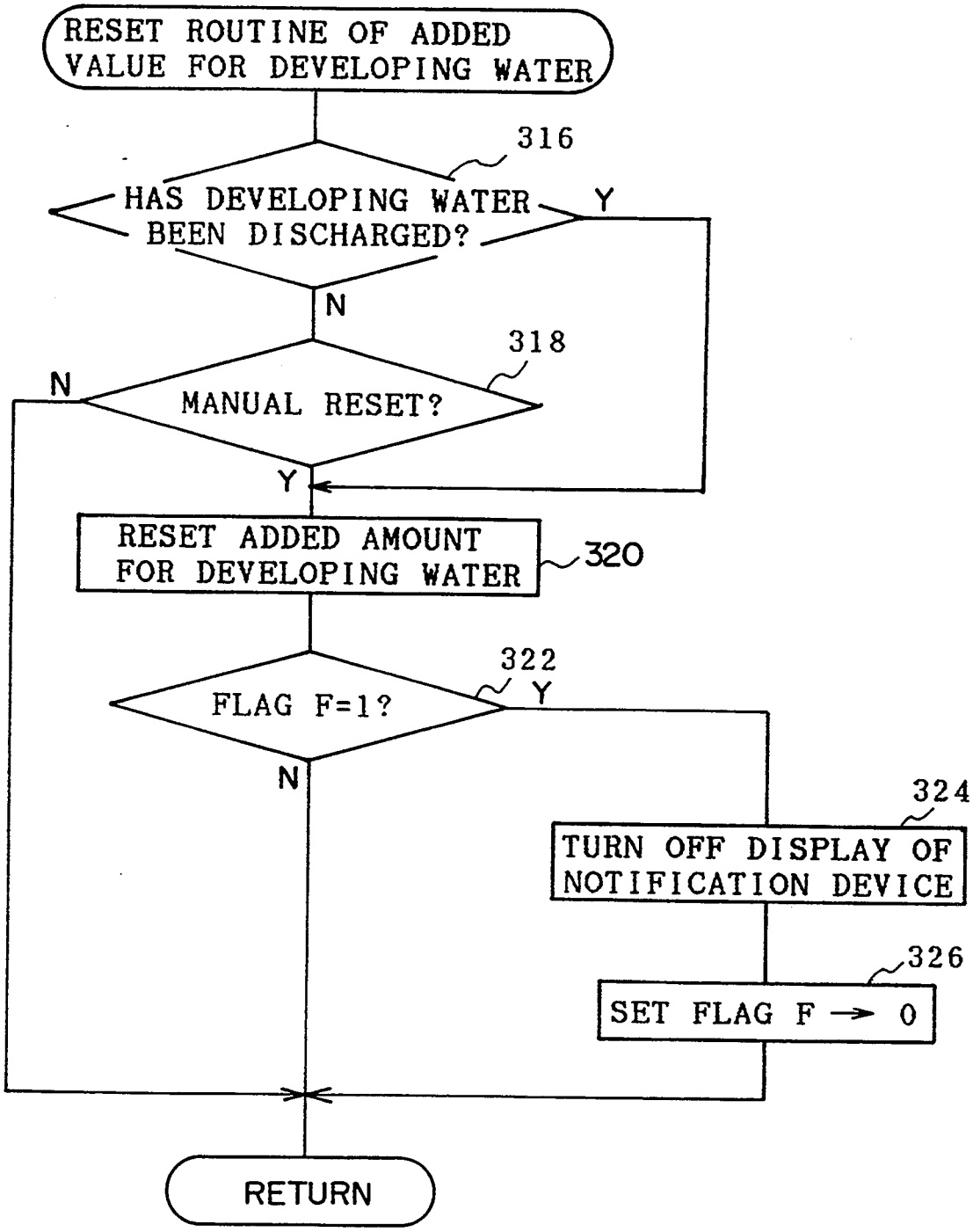
FIG. 4B is a flowchart illustrating a resetting of an integrated value of amounts processed with respect to the developing water.

In FIG. 4B, a reset routine which resets the integrated value of the amounts processed by the developing water 18 is shown. This reset routine can interrupt the above-described addition routine at any arbitrary step.

In the reset routine, first, a determination is made in step 316 as to whether the developing water 18 has been changed. The changing of the developing water 18 is effected by the valve 130 being opened so that the developing water 18 within the developing water recovery tank 22 is discharged from the drain 132. In this way, the float switch 134 within the developing water recovery tank 22 moves down along with the drop in the liquid level of the developing water 18. When the float switch 134 reaches the bottom, the contacting point is switched. In this way it is determined that the developing water 18 has been discharged from the developing water recovery tank 22. Thereafter, by filling the developing water 18 into the developing water recovery tank 22, the float switch 134 detects the rise in the liquid level of the developing water 18. It suffices to determine that the developing water 18 has been changed.

Further, in step 318, it is determined whether a reset signal has been input manually from the operation panel 142.

When a reset signal has been input automatically by the discharging of the developing water 18 or has been input manually, the integrated value of the amounts processed by the developing water 18 is reset (step 320).

In step 322, the condition of the flag F is detected. When the flag F is "1", the notification device 56 displays that the developing water 18 has been changed. This display is turned off (step 324), and the flag F is set to "0" (step 326).

Figure 5A:
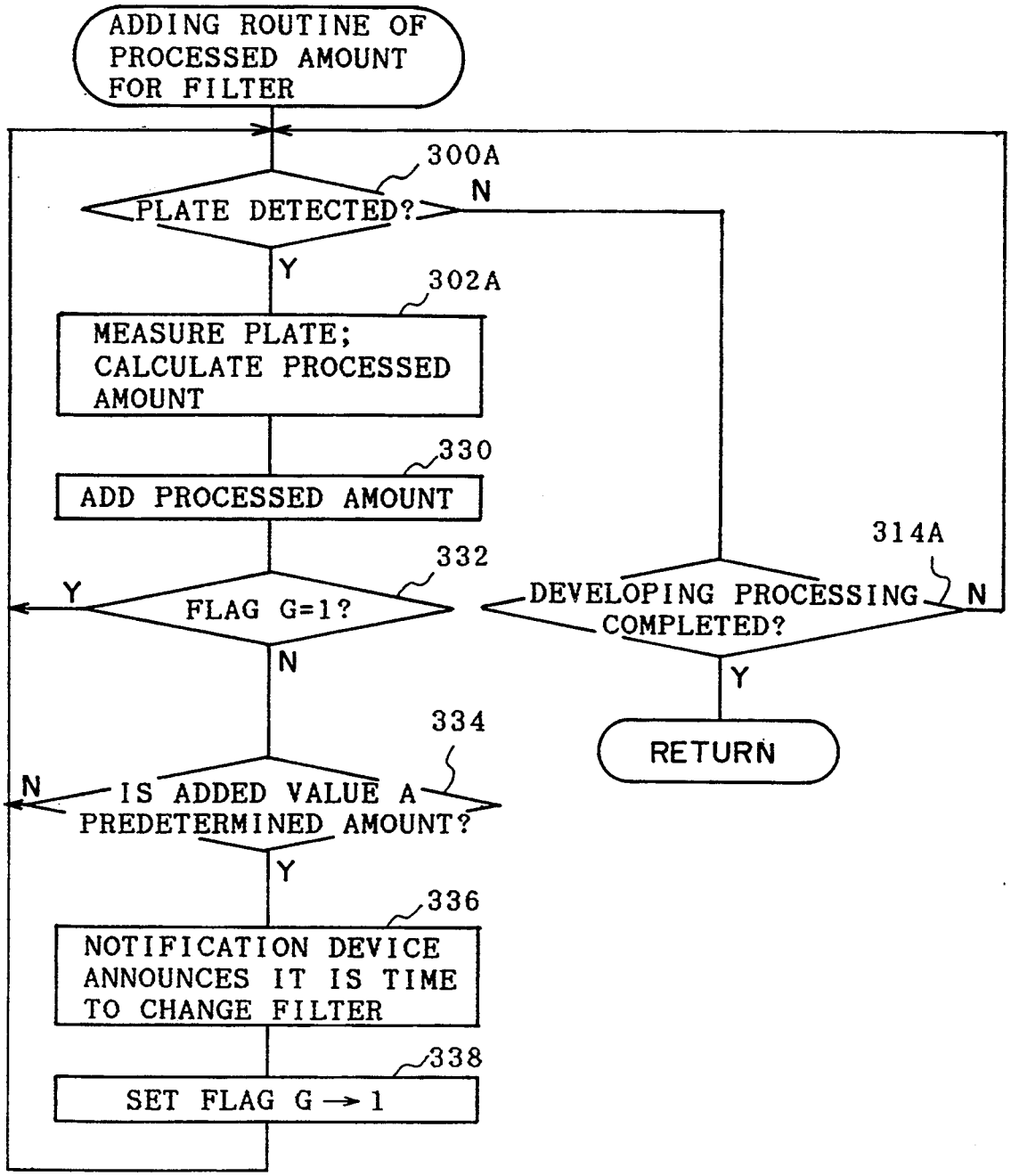
FIG. 5A is a flowchart illustrating an integration of an amount processed with respect to a developing water filter.
Figure 5B:
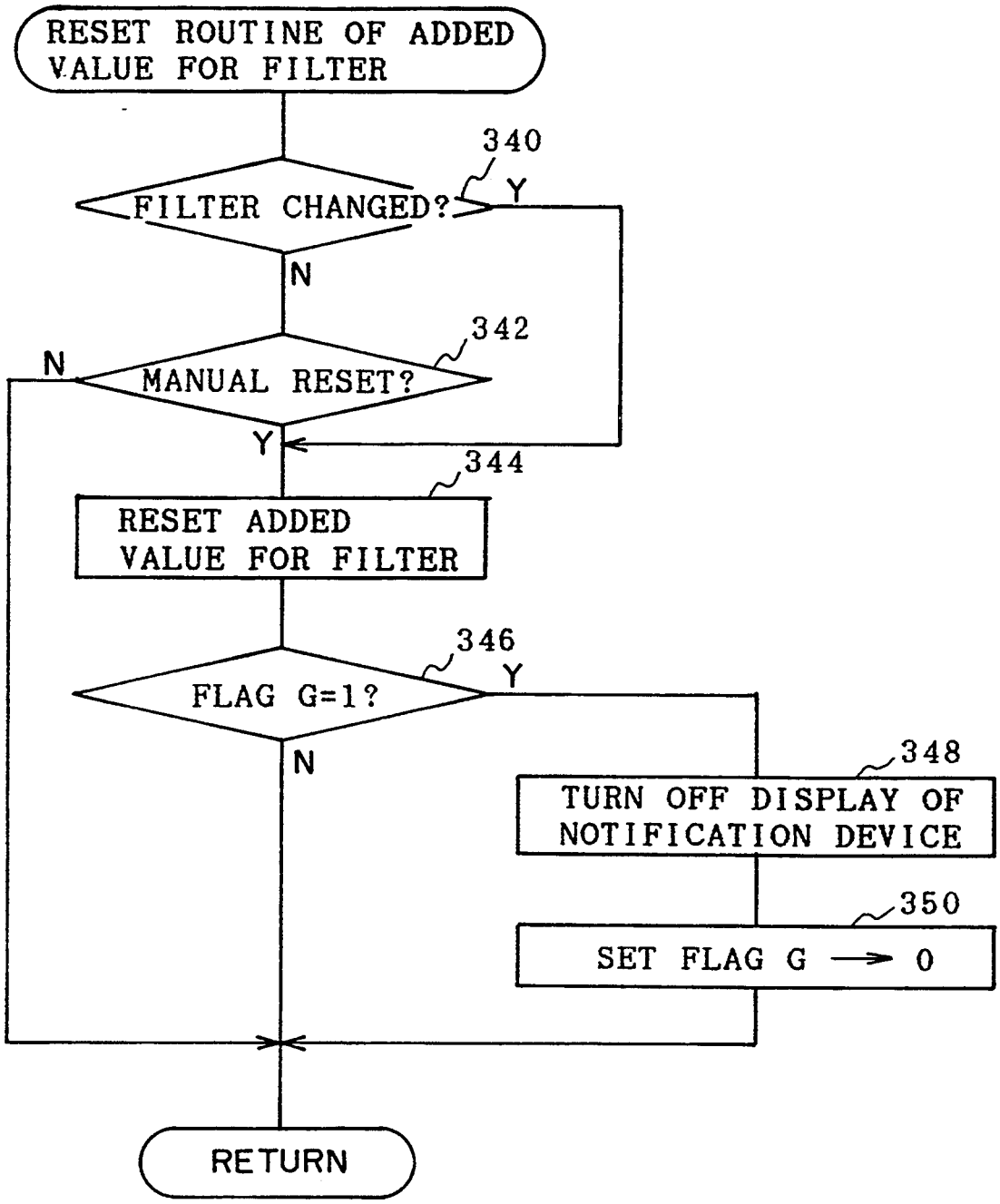
FIG. 5B is a flowchart illustrating a resetting of an integrated value of amounts processed with respect to the developing water filter.

Next, the operation of the counter for the developing water 18 filter, as shown in FIGS. 5A and 5B, will be described. Steps 300A, 302A, and 314A show the same operations as steps 300, 302, and 314, respectively. Explanation of steps 300A, 302A, and 314A is therefore omitted.

A flag G of the adding routine, shown in FIG. 5A, of the counter for the developing water 18 filter is ordinarily "0". When the flag G is "1", the amount of the waterless PS plate 12 processed by the filter 46 reaches a predetermined amount, and it is indicated that it is time to change the filter 46.

In step 330, the processed amount of the waterless PS plate 12 calculated in step 302A is integrated, and the integrated value is stored. Further, in step 332, the state of the flag G is determined. In step 334, if it is determined that the integrated value has reached the predetermined amount, the notification device 56 displays that it is time to change the filter 46 of the developing water 18 (step 336), and the flag G is set to "1". When the flag G is "1", the integrated amount has already reached the predetermined value. In step 332, a determination is made as to the state of the flag G. When the flag G is "1", only addition of the processed amount of the waterless PS plate 12 is effected.

In the reset routine, shown in FIG. 5B, of the counter of the filter 46, it is determined in step 340 whether the filter 46 is being changed. The changing of the filter 46 is detected by the filter switch 138 whose contacting point is switched by the removal of the filter 46. In this case, the changing of the filter 46 may be determined by the removal of the filter 46, or may be determined by the contacting point of the filter switch 138 being switched again by the installation of a new filter 46.

Figure 8:
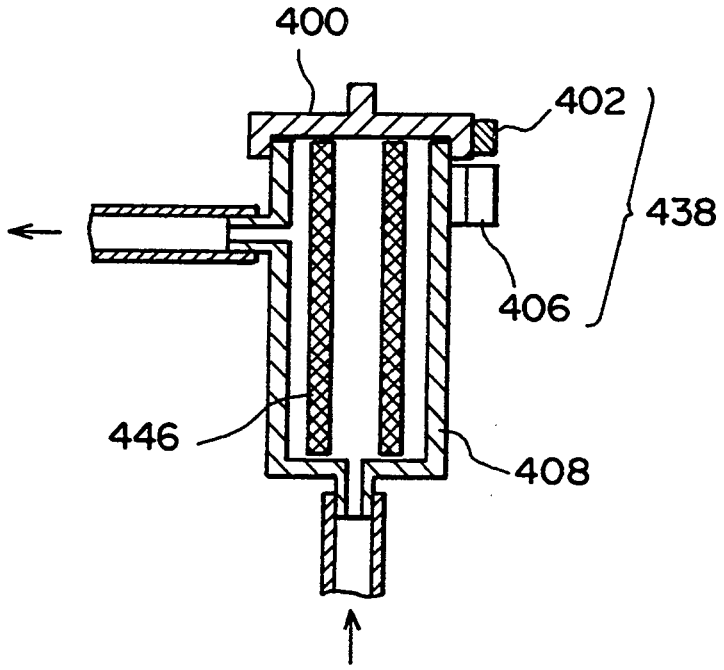
FIG. 8 is a cross-sectional view illustrating a filter switch utilizing a reed switch.
Figure 9:
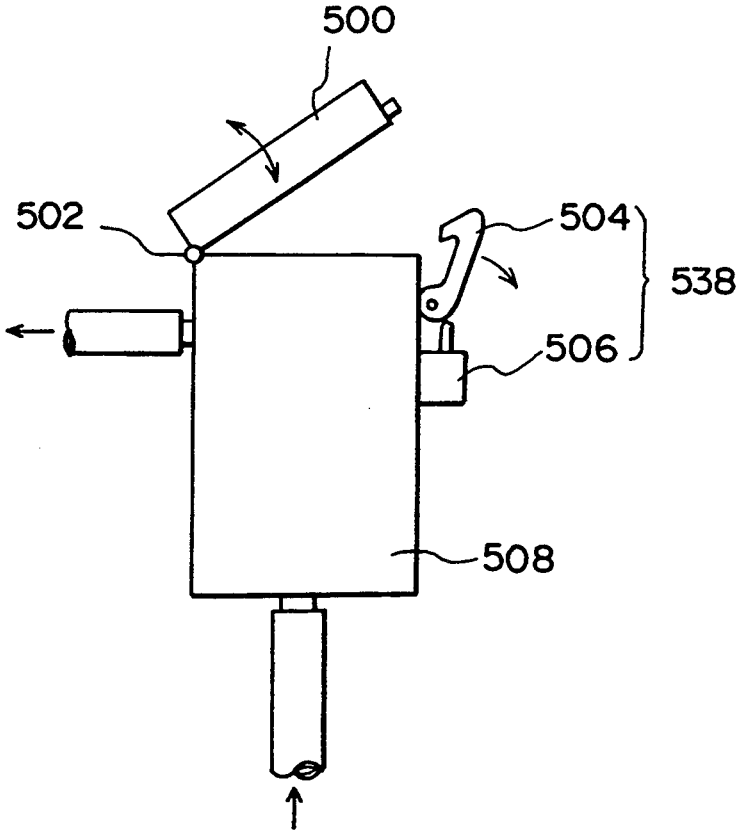
FIG. 9 is a schematic view illustrating a filter switch utilizing a mi micro-switch.

FIG. 8 and 9 illustrate examples of the filter switch 138 in detail.

FIG. 8 shows a filter switch 438 which utilizes a reed switch 406. FIG. 8 also illustrates a magnet 402 provided on a filter case cover 400. When a filter 446 within a filter case 408 needs changing, the reed switch 406 senses the opening and closing operation of the filter case cover 400 by the magnet 402 and thereby it is detected that the filter 446 has been changed.

FIG. 9 shows a filter switch 538 which utilizes a micro-switch 506. The micro-switch and a fastening hook 504 are provided on a filter case 508. Through the movement of the hook 504, contact in the micro-switch 506 is made and broken. A filter case cover 500 is mounted to the filter case 508 via a hinge 502. In order to open and close the filter case cover 500 when a filter (not shown) within the filter case 508 needs changing, the hook 504 must be moved to engage or disengage from the filter case cover 500. The micro-switch 506 senses the movement of the hook 504 and thereby it is detected that the filter has been changed.

In step 342, a determination is made as to the existence of a reset signal of the filter 46 counter from the operation panel 142.

When a reset signal is input automatically by the changing of the filter 46 or is input manually, the integrated value for the filter 46 is reset (step 344).

In step 346, the state of the flag G is detected. When the flag G is "1", the notification device 56 displays the changing of the filter 46. This display is turned off (step 348), and the flag G is set to "0" (step 350).

The reset routine automatically resets the integrated value even if the filter 46 is changed before the integrated amount reaches the predetermined value.

The changing of the developing water 18 and the filter 46 of the developing water 18 have been described above. By changing the squeezing solution 17 and the filter 116 of the squeezing solution 17, the amounts of the waterless PS plate 12 processed can be added and reset.

In this way, at the waterless PS plate processing apparatus 10, the amounts of the waterless PS plate 12 processed are counted. For each counter, when the integrated value of the counter becomes the respective predetermined value, it is displayed that it is time to change the processing solution or filter associated with that counter. When the solution or filter has been changed, the integrated value corresponding thereto is automatically reset. As a result, an accurate processed amount for each of the developing water 18, the squeezing solution 17, the filter 46 of the developing water, and the filter 116 of the squeezing solution is always added. The times at which the developing water 18, the squeezing solution 17, and the filters 46, 116 are to be changed are thereby not missed. Further, even if the filter 46 is changed earlier than expected, e.g., when there are more scrapings 18A than anticipated or the like, the counter can be reset in order to correspond to such a situation. Accordingly, the waterless PS plate processing apparatus 10 can be operated under proper conditions.

Further, the filter 46 may be changed when the flow rate of the conduit 38 measured by the flow rate sensor 50 decreases. When the filter 46 becomes clogged because it is full of scrapings 48, the circulating flow rate of the developing water 18 passing through the conduit 38 decreases. The flow rate sensor 50 detects this decrease, and transmits the detected results to the control device 52. The control device operates the notification device 56 which announces that the filter 46 has become blocked. In this way, the operator can know that it is time to replace the filter 46 with a new one.

In this case as well, the filter switch 138 detects that the filter 46 has been changed, and can reset the corresponding integrated value. A general flow meter can be used as the flow rate sensor 50, but it is preferable that a rotary-type sensor be used in order to make the apparatus compact.

Further, the integrated value of each counter can be arbitrarily reset by the operator.

The float switches 134, 136 are provided respectively in the developing water recovery tank 22 and the squeezing solution recovery tank 92 in order to detect that the developing water 18 and the squeezing solution 17 have been discharged. However, the detection means is not limited to a float switch which detects variations in the liquid level; other detection means can be used.

Figure 3A:
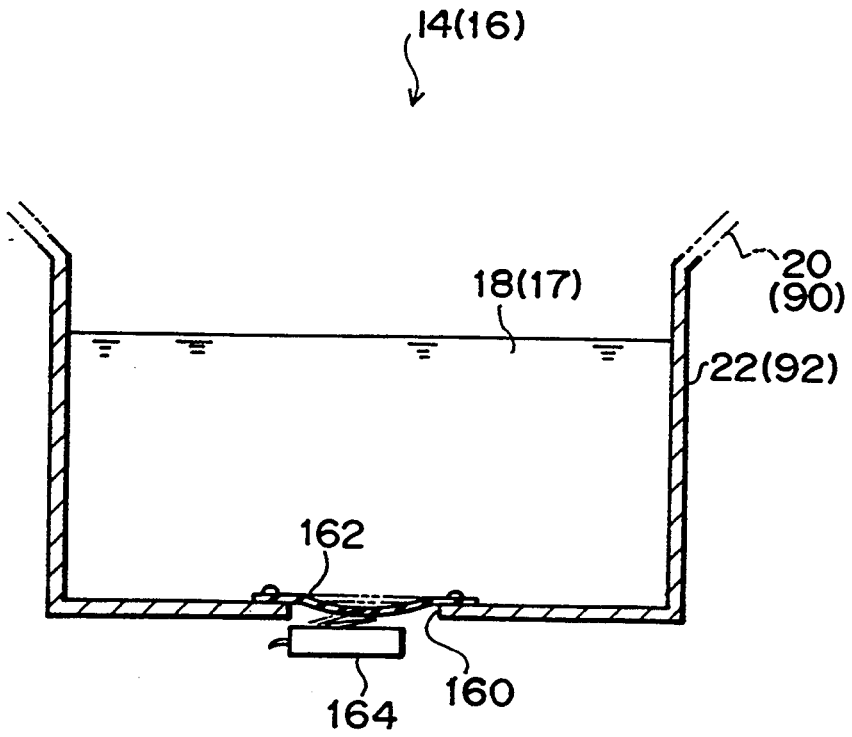
FIGS. 3A and 3B are schematic views illustrating variations of a detecting means relating to the present embodiment.

For example, as shown in FIG. 3A, a diaphragm-type pressure switch may be formed in which a through-hole 160 is provided in the bottom portion of the developing water recovery tank 22. The through-hole 160 is closed off by a separating membrane 162 formed of an elastic, thin membrane such as a rubber or a resin sheet. A microswitch 164 is disposed beneath the separating membrane 162. When developing water is stored in the developing water recovery tank 22, the separating membrane 162 elastically deforms due to the pressure of the developing water, and the microswitch 164 is pressed. However, when the separating wall 162 is restored to its original state by the discharging of the developing water, the separating wall 162 moves away from the microswitch 164. Accordingly, the contacting point of the microswitch 164 is switched. This type of structure may be used to detect the discharging of the developing water.

Figure 3B:
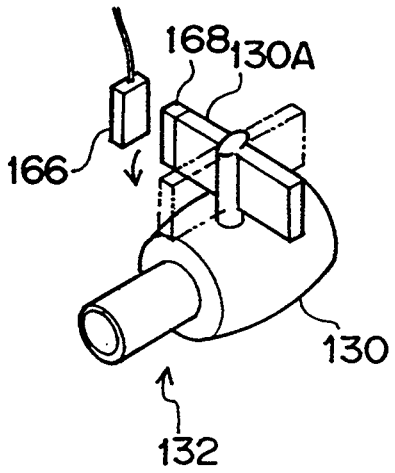

Further, a structure may be provided in which the opening and closing of the valves 130 of the discharging means is detected. As shown in FIG. 3B, a magnet 168 or the like which operates a lead switch 166 may be provided at a handle 130A of the valve 130 of the drain 132. By opening the valve 130, the magnet 168 is made to oppose the lead switch 166. Accordingly, the contacting point of the lead switch 166 is switched, and the control device 52 detects that the valve 130 has been opened. By detecting that the valve 130 has been opened, it may be determined that the developing water within the developing water recovery tank 22 has been discharged. In this case, it is preferable that the control device 52 detect the time for the developing water to be completely discharged from the drain 132 and detect the open state of the valve 130. Other than the lead switch 166, a proximity switch, such as a photoelectric switch, or a detecting means, such as a microswitch or the like, which detects by mechanical contact, as well as other methods can be used to detect the opening and closing of the valve 130.

Second Embodiment

Next, the second embodiment of the present invention will be described. The second embodiment is basically structured in the same way as the first embodiment. Similar parts are denoted with similar reference numerals, and description thereof is omitted.

The control device 52 adds the replenished amounts of developing water which are replenished by operation of the water replenishing pump 78 which supplies developing water to the developing water recovery tank 22. When the integrated value of the amounts of replenished developing water, which corresponds to the developing water 18 or the filter 46, reaches a predetermined value, the notification device 56 announces this.

When the insertion of the waterless PS plate 12 into the waterless PS plate processing apparatus 10 is detected by the plate detection sensor 86, the replenishing of the developing water 18 to the developing water recovery tank 22 is effected by the control device 52 operating the water replenishing pump 78 for a fixed time in accordance with the surface area processed. The discharge amount of the water replenishing pump 78 is stored in advance in the control device 52. The amount of water replenished can be calculated by the operating time. This calculated value is integrated as the amount replenished.

The discharge amount of the squeezing solution replenishing pump 124, which replenishes the squeezing solution to the squeezing solution recovery tank 92, is stored in the control device 52. Each time the insertion of the waterless PS plate 12 is detected by the plate detection sensor 86, a predetermined amount of squeezing solution 17 is replenished to the squeezing solution recovery tank 92 in accordance with the processed surface area. Further, when the discharge amount of one operation of the squeezing solution replenishing pump 124 is determined, the number of times the pump is operated is counted so that the replenishing amount may be calculated.

Next, the second embodiment of the present invention will be described in accordance with the flowcharts in FIGS. 6A and 6B. In steps 300B, 310A, 314B, 316A, 318A, and 324A, the same operations are performed as in steps 300, 310, 314, 316, 318, and 324, respectively, of the flowchart shown in FIG. 4A.

Figure 6A:
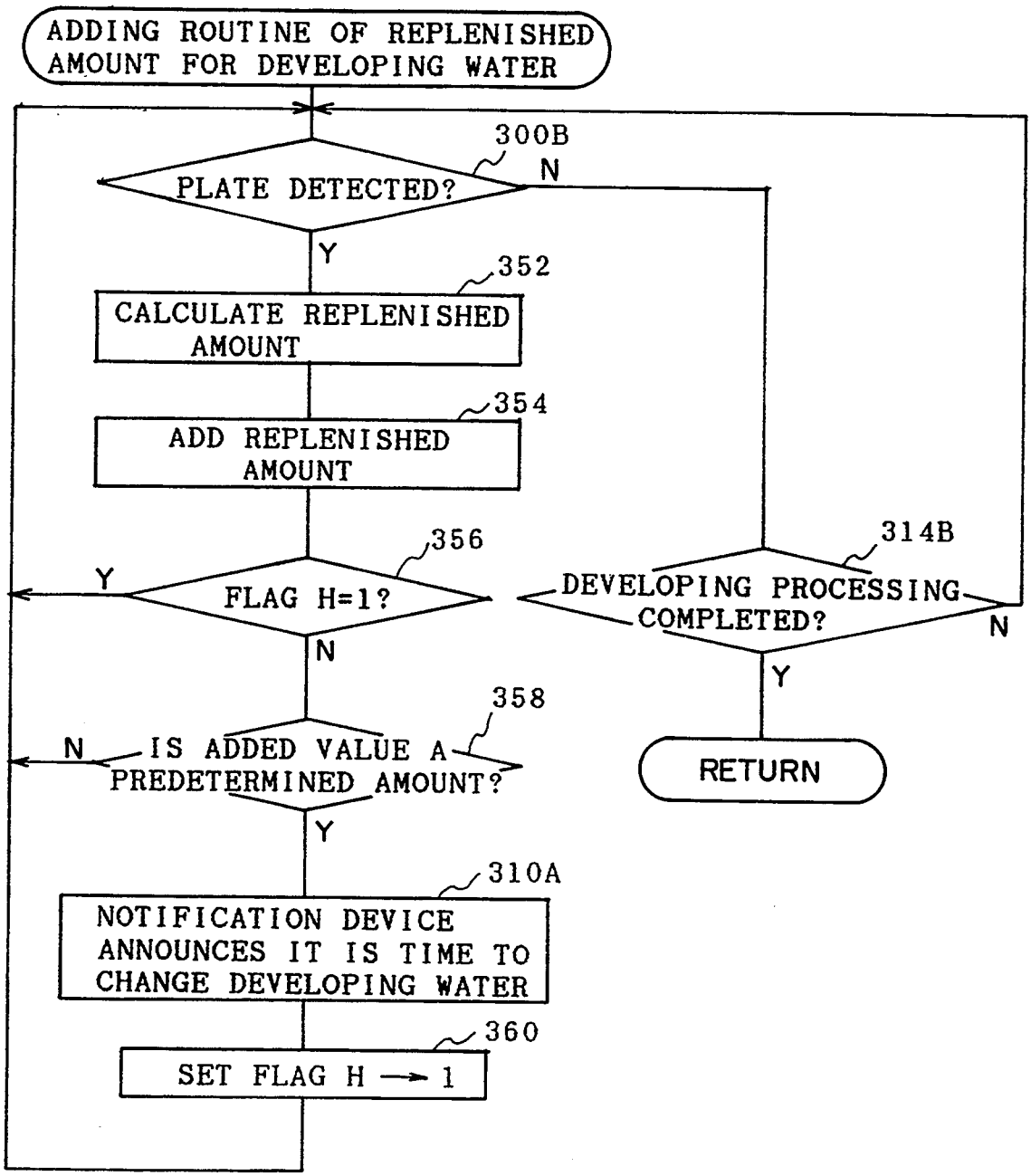
FIG. 6A is a flowchart illustrating a second embodiment of an integration of an amount of water replenished with respect to developing water.

In the flowchart shown in FIG. 6A, the amount of the developing water 18 replenished is added, and the time to change the developing water 18 is displayed.

When the insertion of the waterless PS plate 12 is detected, in step 352, the amount of water replenished, which corresponds to the processed area, is calculated, and the replenished amount is integrated (step 354). In step 356, the condition of a flag H is detected. The flag H is usually set to "0". However, when the integrated value reaches a predetermined amount, the flag H is set to "1".

In step 358, it is determined whether the integrated value has reached the predetermined amount. If the integrated value has not reached the predetermined amount, the amounts of water replenished are successively added. Further, when the integrated value reaches the predetermined amount, the notification device 56 announces this (step 310A), and the flag H is set to "1" (step 360). In this case, the integrated value of the amounts of water replenished is displayed on the counter by the notification device 56. Both the integrated value and an alarm may be used to notify the operator, or an alarm alone may be used. Further, when the flag H is set to "1", the processing of the waterless PS plate 12 can be continued.

Figure 6B:
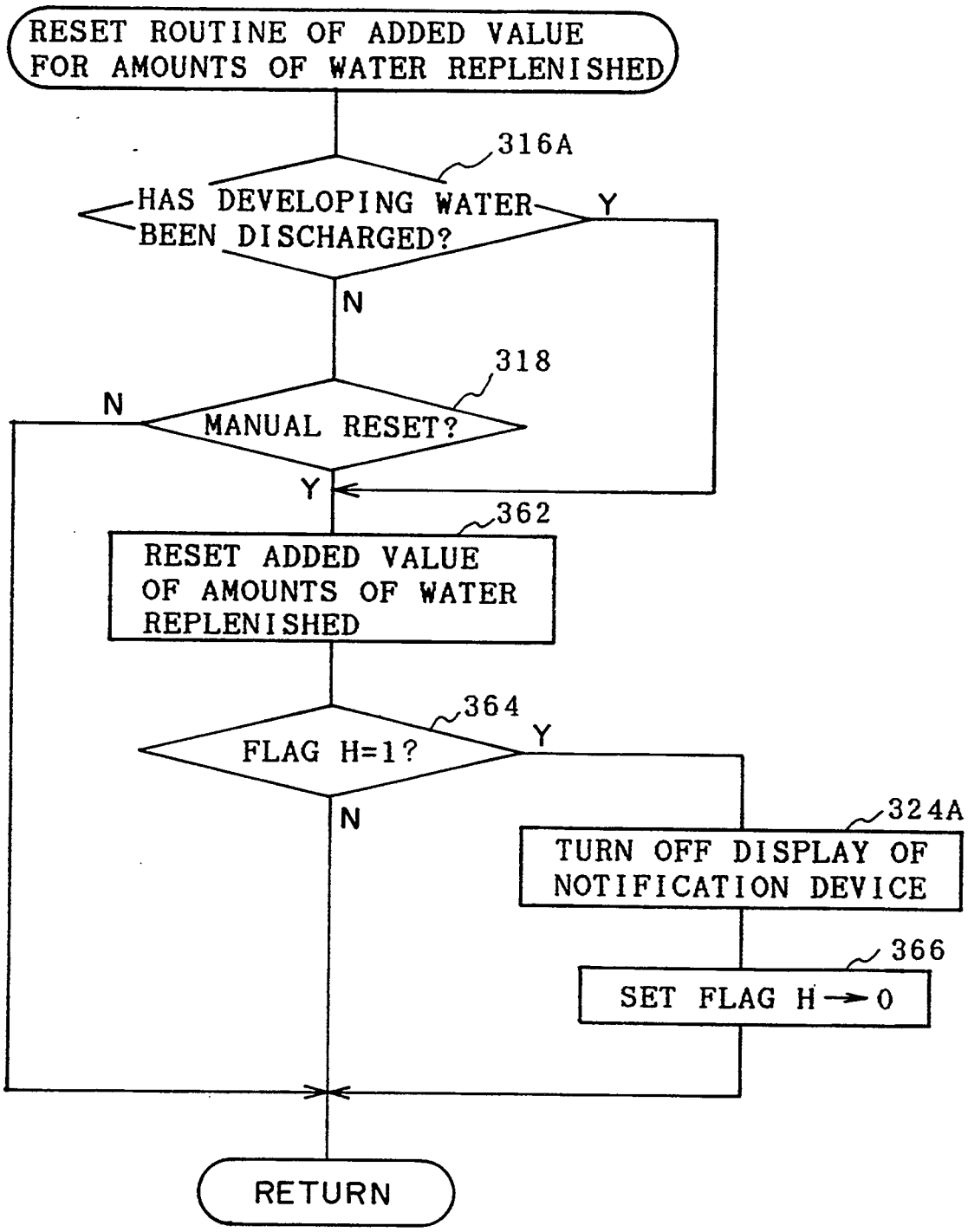
FIG. 6B is a flowchart illustrating a resetting of an integrated value of amounts replenished with respect to the developing water.

The reset routine of the integrated value of the amounts of water replenished is shown in FIG. 6B.

When the counter is reset by the float switch 134 when the developing water 18 is discharged from the developing water recovery tank 22 (step 315A) or when the counter is reset manually (step 318A), the integrated value of the amounts of water replenished is reset (step 362). Further, the condition of the flag H is determined (step 364). When the flag H is determined to be "1", the display of the notification device 56 is turned off (step 324A), and the flag H is set to "0" (step 366).

Figure 7A:
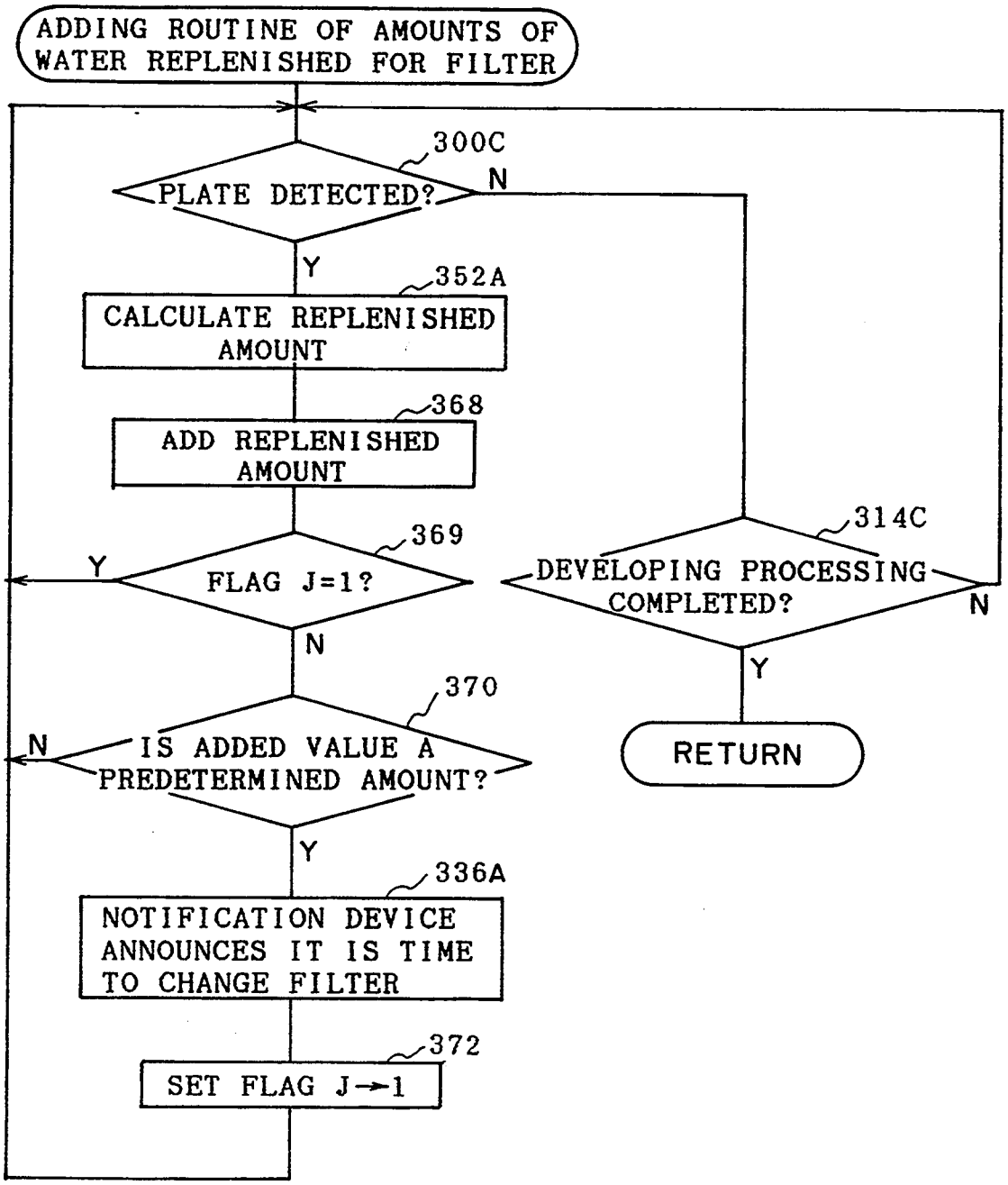
FIG. 7A is a flowchart illustrating an integration of an amount of water replenished with respect to a developing water filter.
Figure 7B:
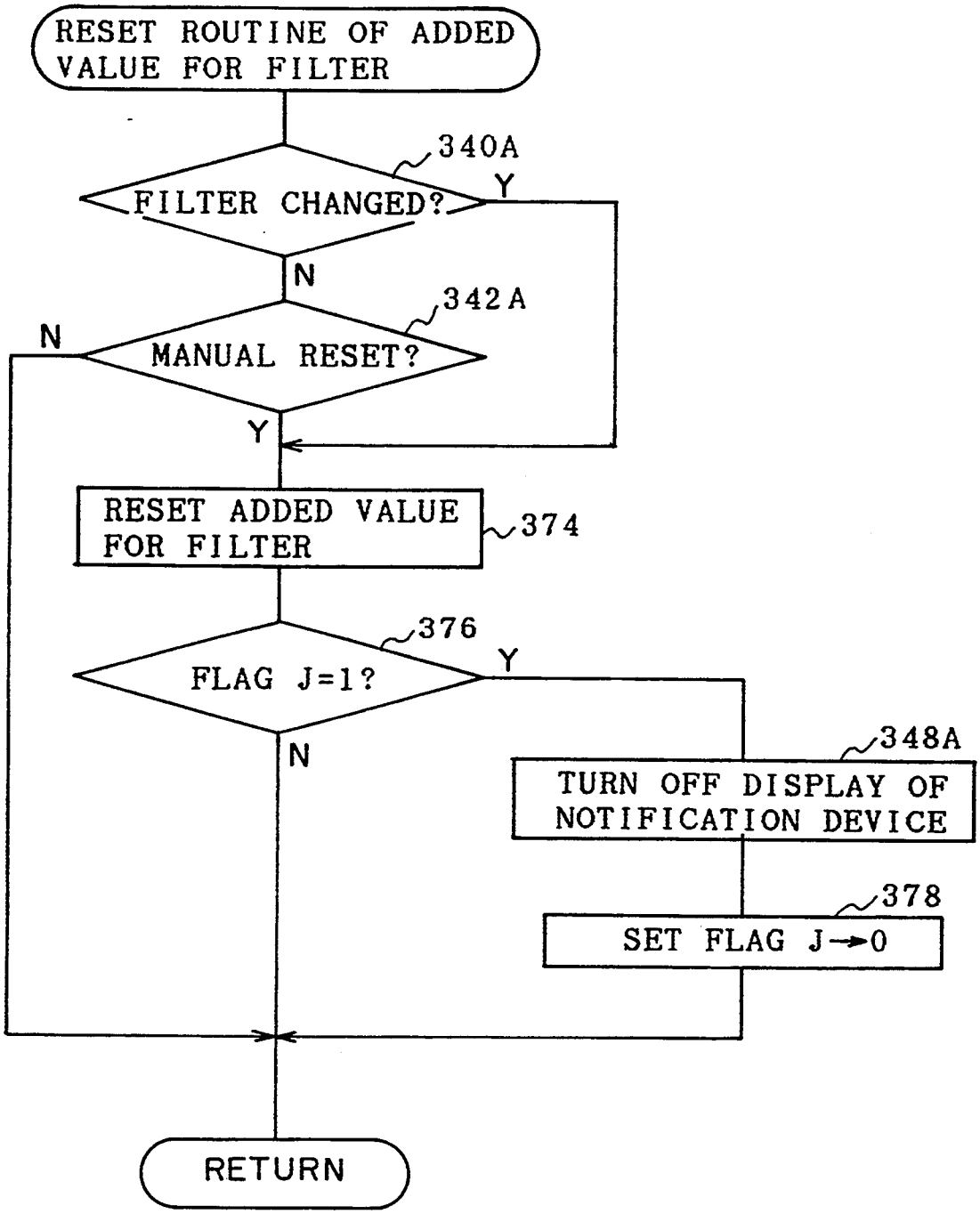
FIG. 7B is a flowchart illustrating a resetting of an integrated value of amounts replenished with respect to the developing water filter.

Flowcharts relating to the filter 46 are shown in FIGS. 7A and 7B. In steps 300C, 352A, 336A, 314C, 340A, 342A, and 348A, the operations are the same, respectively, as those in steps 300, 352, 336, 314, 340, 342 and 348 of FIGS. 5A through 6B.

In the flowchart shown in FIG. 7A, an amount of water replenished for the filter 46 is integrated.

The amount of water replenished, which is replenished in accordance with the amount of the waterless PS plate 12 processed, is integrated (step 368). In step 369, the condition of the flag J is detected. The flag J is ordinarily set to "0". However, when the integrated value reaches a predetermined amount, the flag J is set to "1".

As the processing of the waterless PS plates 12 continues, water is replenished, and the developing water 18 is filtered by the filter 46. When the amount of water replenished reaches the predetermined value (step 370), it is announced that it is time to change the filter 46 (step 336A), and in step 372 the flag J is set to "1".

FIG. 7B is a reset routine of the integrated value for the filter 46. When the filter switch 134 detects the changing of the filter 46 (step 340A) or resetting is effected manually (step 342A), in step 372 the integrated value for the filter 46 is reset. In step 376, the condition of the flag J is detected. If the flag J is "1", the display of the notification device 56 is turned off (step 348A), and the flag J is set to "0" (step 342).

In this way, even if the amounts of the developing water 18 replenished, which are replenished in accordance with the amounts of the waterless PS plate 12 processed, are integrated, the replenished amounts can be used as criteria for the time of changing the developing water 18 and the time of changing the filter 46. By resetting each integrated amount automatically, developing processing of the waterless PS plate 12 can be effected under optimal conditions. Further, the squeezing solution 17 and the filter 116 are changed in the same way.

The present embodiment was described as an example applicable to the waterless PS plate processing apparatus 10 at which developing processing of the waterless PS plate 12 is effected. However, the present embodiment is not limited to processing of the waterless PS plate 12. The present embodiment can be applied to photosensitive material processing apparatuses which process other photosensitive materials, such as photosensitive lithographic printing plates, silver salt photosensitive materials, and the like. The present embodiment is applicable to a photosensitive material processing apparatus in which, along with the processing of a predetermined amount of photosensitive material, processing solutions for effecting processing and filters which filter the processing solutions are changed.

What is claimed is:

1. A photosensitive material processing apparatus for processing a photosensitive material upon which an image is exposed, by a processing solution stored in a processing tank, while said photosensitive material is being conveyed, comprising:

a processed amount integration device for integrating a processed amount of said photosensitive material;

first notification means for indicating that a processed amount has been integrated by said processed amount integration device;

discharging means for discharging said processing solution from said processing tank;

first detecting means for detecting that said processing solution has been discharged from said processing tank by said discharging means; and first resetting means for resetting said processed amount integration device when discharge of said processing solution is detected by said first detecting means.

2. An apparatus according to claim 1, wherein said discharging means has a valve used for discharging said processing solution, and said first detecting means detects the discharging of said processing solution by detecting an opening and/or closing of the valve.

3. An apparatus according to claim 1, wherein said first detecting means detects the discharging of said processing solution based on a drop in a liquid level of said processing solution within said processing tank.

4. An apparatus according to claim 1, wherein said first detecting means is a pressure sensitive switch provided at a bottom portion of said processing tank and operates by a pressure of said processing solution within said processing tank, said first detecting means detecting the discharging of said processing solution by operation of said switch.

5. An apparatus according to claim 1, further comprising:

second notification means for indicating that a second integrated processed amount has been integrated by said processed amount integration device;

second detecting means for detecting that said filter has been changed; and second resetting means for resetting said processed amount integration device when change of said filter is detected by operation of said second detecting means.

6. A photosensitive material processing apparatus for processing a photosensitive material upon which an image is exposed, by a processing solution stored in a processing tank, while said photosensitive material is being conveyed, comprising:

a processed amount integration device for integrating a processed amount of said photosensitive material;

notification means for indicating that a processed amount has been integrated by said integration device;

detecting means for detecting that a filter which filters said processing solution has been changed;

resetting means for resetting said integration device when change of said filter is detected by said detecting means.

7. An apparatus according to claim 6, wherein said detecting means detects that said filter has been changed by detecting at least one of a removal and an installation of said filter.

8. An apparatus according to claim 1, wherein said photosensitive material comprises printing plates.

9. A photosensitive material processing apparatus for processing a photosensitive material upon which an image is exposed, by a processing solution stored in a processing tank, while said photosensitive material is being conveyed, comprising:

a replenishing solution amount integration device for integrating an amount of replenishing solution replenished to said processing tank;

first notification means for indicating that an amount of replenishing solution has been integrated by said replenishing solution amount integration device;

discharging means for discharging said processing solution from said processing tank;

first detecting means for detecting that said processing solution within said processing tank has been discharged by said discharging means;

first resetting means for resetting said replenishing solution amount integration device when a discharging of said processing solution is detected by said first detecting means.

10. A photosensitive material processing apparatus according to claim 9, wherein said discharging means has a valve used for discharging said processing solution, said first detecting means detecting the discharging of said processing solution by detecting an opening and/or closing of the valve.

11. An apparatus according to claim 9, wherein said first detecting means detects the discharging of said processing solution based on a drop in a liquid level of said processing solution within said processing tank.

12. An apparatus according to claim 9, wherein said first detecting means is a switch provided at a bottom portion of said processing tank and sensing based on a pressure of said processing solution within said processing tank, said first detecting means detecting the discharging of said processing solution by operation of said switch.

13. A photosensitive material processing apparatus according to claim 9, further comprising:

second notification means for indicating that a second integrated amount of replenishing solution has been integrated by said replenishing solution amount integration device;

second detecting means for detecting that said filter has been changed; and second resetting means for resetting said added value of replenishing solution amounts for said filter when a changing of said filter is detected by operation of said second detecting means.

14. An apparatus according to claim 9, wherein said photosensitive material comprises printing plates.

15. A photosensitive material processing apparatus for processing a photosensitive material upon which an image is exposed, by a processing solution stored in a processing tank, while said photosensitive material is being conveyed, comprising:

a replenishing solution amount integration device for integrating amounts of replenishing solution replenished to said processing tank;

notification means for indicating that an integration value of replenishing solution has been integrated by said replenishing solution amount integration device;

detecting means for detecting that a filter which filters said processing solution has been changed;

resetting means for resetting said integration device when a changing of said filter is detected by operation of said detecting means.

16. An apparatus according to claim 15, wherein said detecting means detects that said filter has been changed by detecting at least one of a removal and an installation of said filter.

17. A photosensitive material processing apparatus for processing a photosensitive material upon which an image is exposed, by a processing solution stored in a processing tank, while said photosensitive material is being conveyed, comprising:

a processed amount integration device for integrating processed amounts of said photosensitive material;

first notification means for indicating that a processed amount integrated value has been integrated so that a filter should be changed;

measuring means for measuring a flow rate of said processing solution through said filter;

flow rate drop detecting means for detecting a drop in said flow rate;

second notification means for indicating, based on results of detection by said flow rate drop detecting means, that said filter should be changed;

filter change detecting means for detecting that said filter has been changed; and resetting means for resetting said processed amount integration device.

18. A photosensitive material processing apparatus according to claim 17, wherein said filter change detecting means detects that said filter has been changed by detecting at least one of a removal and an installation of said filter.

19. A photosensitive material processing apparatus for processing a photosensitive material upon which an image is exposed, by a processing solution stored in a processing tank, while said photosensitive material is being conveyed, comprising:

a replenishing solution amount integration device for integrating an amount of replenishing solution replenished to said processing tank;

first notification means for indicating that an integrated value of replenishing solution amount has been integrated so that a filter should be changed;

measuring means for measuring a flow rate of said processing solution through said filter;

flow rate drop detecting means for detecting a drop in said flow rate;

second notification means for indicating, based on results of detection by said flow rate drop detecting means, that said filter should be changed;

filter change detecting means for detecting that said filter has been changed; and resetting means for resetting said integration device when a changing of said filter is detected by operation of said filter change detecting means.

20. A photosensitive material processing apparatus according to claim 19, wherein said filter change detecting means detects that said filter has been changed by detecting at least one of a removal and an installation of said filter.

* * * * *